US010251426B2

(12) United States Patent
Nielsen

(10) Patent No.: US 10,251,426 B2
(45) Date of Patent: Apr. 9, 2019

(54) ELECTRONIC NICOTINE DELIVERY SYSTEM

(71) Applicant: FERTIN PHARMA A/S, Vejle (DK)

(72) Inventor: Bruno Provstgaard Nielsen, Vejle Ost (DK)

(73) Assignee: FERTIN PHARMA A/S, Vejle (DK)

( * ) Notice: Subject to any disclaimer, the term of this patent is extended or adjusted under 35 U.S.C. 154(b) by 70 days.

(21) Appl. No.: 15/516,324

(22) PCT Filed: Oct. 3, 2014

(86) PCT No.: PCT/DK2014/050312
§ 371 (c)(1),
(2) Date: Mar. 31, 2017

(87) PCT Pub. No.: WO2016/050244
PCT Pub. Date: Apr. 7, 2016

(65) Prior Publication Data
US 2017/0251727 A1 Sep. 7, 2017

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS 4,765,347 A * 8/1988 Sensabaugh, Jr. .... A24F 47/002 131/173

6,715,487 B2 * 4/2004 Nichols ..... A61M 15/00 128/200.14

(Continued)

FOREIGN PATENT DOCUMENTS

EP 2732713 A1 5/2014

OTHER PUBLICATIONS

Patent Cooperation Treaty: International Search Report and Written Opinion for PCT/DK2014/050312; Kock, Soren; dated Jul. 9, 2015; 10 pages.

(Continued)

*Primary Examiner* — James Harvey
(74) *Attorney, Agent, or Firm* — Gregory M. Howison

(57) ABSTRACT

An electronic nicotine delivery system (ENDS) is disclosed, said electronic nicotine delivery system (ENDS) comprising a mouth piece (MP), an atomizer arrangement (AA), a power supply (PS), a nicotine container (NC), an additive container (AC), the atomizer arrangement (AA) comprising an inlet (NCI) from the nicotine container (NC) and an inlet (ACI) from the additive container (AC), the atomizer arrangement (AA) comprising two separate atomizers, a first atomizer (FA) and a second atomizer (SA), the first atomizer producing nicotine-containing aerosols having a first mass median aerodynamic diameter (FMMAD) and the second atomizer producing additive-containing aerosols having a second mass median aerodynamic diameter (SMMAD) and wherein the second mass median aerodynamic diameter (SMMAD) is greater than the first mass median aerodynamic diameter (FMMAD), the atomizers being electrically connected to the power supply (PS). Furthermore, a method of producing a mixture of aerosols, an aerosol mixture and a use of an electronic nicotine delivery system (ENDS) is disclosed.

18 Claims, 11 Drawing Sheets

(56) References Cited

U.S. PATENT DOCUMENTS

| | | | | |
|---|---|---|---|---|
| 2008/0241255 | A1* | 10/2008 | Rose | A61K 31/4439 424/489 |
| 2012/0006342 | A1 | 1/2012 | Rose et al. | |
| 2012/0048266 | A1 | 3/2012 | Alelov | |
| 2014/0060527 | A1 | 3/2014 | Liu | |
| 2014/0261488 | A1 | 9/2014 | Tucker | |
| 2014/0345635 | A1* | 11/2014 | Rabinowitz | A24B 15/16 131/352 |
| 2016/0309782 | A1* | 10/2016 | Malgat | A24F 47/004 |
| 2017/0251726 | A1* | 9/2017 | Nielsen | A24F 47/008 |
| 2017/0251727 | A1* | 9/2017 | Nielsen | A24F 47/008 |
| 2017/0258140 | A1* | 9/2017 | Rostami | A24F 47/008 |
| 2017/0354184 | A1* | 12/2017 | Mironov | F22B 1/284 |

OTHER PUBLICATIONS

J.F. Bertholon et al.: Electronic Cigarettes: A Short Review; Respiration; Sep. 24, 2013; XP055197664; ISSN: 0025-7931; DOI: 10.11591000353253; the whole document.

* cited by examiner

ELECTRONIC NICOTINE DELIVERY SYSTEM

CROSS-REFERENCE TO RELATED APPLICATIONS

This application is a U.S. National Phase application submitted under 35 U.S.C. § 371 of Patent Cooperation Treaty application serial no. PCT/DK2014/050312, filed Oct. 3, 2014, and entitled ELECTRONIC NICOTINE DELIVERY SYSTEM.

Patent Cooperation Treaty application serial no. PCT/DK2014/050312, published as WO 2016/050244, and is incorporated herein by reference.

TECHNICAL FIELD

The invention relates to electronic nicotine delivery systems.

BACKGROUND

Electronic nicotine delivery systems have become increasingly popular. This comparably new way of delivering nicotine to a user is interesting because it may diminish some of the adverse effects of smoking cigarettes. In this context there is a constant need for improving such devices.

SUMMARY

The invention relates in a first aspect to an electronic nicotine delivery system comprising a mouth piece, an atomizer arrangement, a power supply, a nicotine container, an additive container,

- the atomizer arrangement comprising an inlet from the nicotine container and an inlet from the additive container,
- the atomizer arrangement comprising two separate atomizers, a first atomizer and a second atomizer, the first atomizer producing nicotine-containing aerosols having a first mass median aerodynamic diameter (FMMAD) and the second atomizer producing additive-containing aerosols having a second mass median aerodynamic diameter (SMMAD) and wherein the second mass median aerodynamic diameter (SMMAD) is greater than the first mass median aerodynamic diameter (FMMAD),
- the atomizers being electrically connected to the power supply.

One advantage of the invention may be that a selective delivery system may be obtained, where nicotine-containing aerosols are delivered mostly to the lungs, whereas additive-containing aerosols are delivered mostly to the oral cavity.

By adjusting the aerosol particle size individually for the first and second atomizers, the aerosols from each atomizer may be adjusted for a specific purpose. Thereby, adjusting the aerosol particle size of the nicotine-containing aerosols for lung delivery and the aerosol particle size of the additive-containing aerosols for mouth delivery, a delivery system for delivering nicotine to the lungs and another substance to the oral cavity simultaneously may be obtained.

This may be particularly advantageous e.g. when said additive container comprises substances intended for delivery to the oral cavity. Such substances may include for example pH-controlling agent, flavoring, and other substances.

The size of aerosols produced by the atomizers according to the present invention may be dependent on a number of parameters, which may include the flow velocity of air downstream from the atomizer, the dispensed dose from the respective container, the heating temperature of the atomizer, and the heating time of the atomizer.

Furthermore, the chemical composition of the liquids holding the nicotine and the additive, respectively, may be used to affect the MMAD of the aerosols produced downstream from the atomizer. Relatively high evaporation rates of such carrier substances from the aerosols may aid in obtaining smaller particles. Evaporation rates may be adjusted by selecting carrier substances having certain boiling points and viscosities. Substances with higher boiling points may stay in the aerosol particles for a longer time compared to substances with lower boiling points which may evaporate fast from the aerosol particles at conditions in the ENDS, whereby smaller aerosol particles may be obtained, other things being equal.

It has surprisingly been found that even for the comparatively short distances the aerosols have to travel from the atomizer to the target zone of delivery, such as the oral cavity or the lungs, the chemical composition of the carrier substances for nicotine and the additive(s) may be used to significantly alter aerosol particle size.

Variation of the air flow velocity at the atomizer and downstream from the atomizer may be controlled by controlling the flow rate and/or the size of the conduit transporting the air.

One further advantage of the invention may be that the electronic nicotine delivery system is safer, especially against unintentional contact, such as consummation or dermal contact, of the container content. This increased safety is facilitated by using both a nicotine container and an additive container. Especially, when flavoring is included in the additive container, the electronic nicotine delivery system may be safer.

Often, electronic nicotine delivery system contains nicotine and flavoring in the same container. This, however, makes children attracted to the container, due to the flavorings, which may e.g. be candy, fruit or bubblegum flavorings. If the attracted child manages to open the container, and consume its content it may often have harmful of even fatal consequences.

However, by keeping the flavoring and the nicotine apart, in separate containers, such tragic events may in many cases be avoided, since the child may only be attracted to the container with the flavoring. Although the content of the additive container may often not be modified for oral consummation, it may often be made non-toxic.

In the context of the present invention the term "mass median aerodynamic diameter (MMAD)" is to be understood as the aerodynamic diameter at which 50% of the particles by mass are larger and 50% of the particles by mass are smaller, i.e. the media diameter when evaluating by mass. The aerodynamic diameter of an irregular particle may be defined as the diameter of a spherical particle with a density of 1000 $kg/m^3$ (kilos per cubic meter) and the same settling velocity as the irregular particle.

In the context of the present invention the term "aerosol" should be understood as a suspension of fine particles in gas, typically a suspension of liquid particles or solid particles in gas, such as air. Individual aerosol components may e.g. be referred to as droplets or particles. Typically, aerosols may be associated with certain sizes, however, in the context of the present invention, the term aerosol may refer to particles having a diameter of up to 100 micrometer. General examples of aerosols may be fog or smoke.

In the context of the present invention the term "atomizer" should be understood as a device comprising a number of parts, the atomizer being arranged for reducing a liquid to a fine spray of droplets, i.e. a device which transforms a liquid into aerosols. One example of an atomizer may be a device that forces a liquid out of a very small hole so that it becomes a fine spray. A further example is a device that uses heating, such as resistive heating, to evaporate a liquid that may form aerosol upon condensation.

In the context of the present invention the term "power supply" should be understood as any electrical portable power source, such as batteries, fuel cells etc.

According to an advantageous embodiment of the invention, the power supply comprises a rechargeable battery.

According to an advantageous embodiment of the invention, the first mass median aerodynamic diameter (FMMAD) is below 5 micrometer.

According to an advantageous embodiment of the invention, the first mass median aerodynamic diameter (FMMAD) is 0.01 to 5 micrometer, such as 0.01 to 4 micrometers, such as 0.01 to 3 micrometers, such as 0.01 to 2 micrometers, such as 0.01 to 1 micrometer; or such as 0.1 to 5 micrometers, such as 0.5 to 5 micrometers.

One advantage of the above embodiment may be that an adaptive delivery system may be obtained. By adapting the size of the aerosols, a higher degree of delivery to the lungs may be obtained. Thereby, the fraction of the nicotine from the nicotine container actually delivered to the lungs may be increased. Furthermore, if the nicotine container comprises further substances intended for lung delivery, the degree of delivery of the substance to the lungs may also be increased. Smaller aerosol particles may remain airborne for a longer time than larger aerosol particles and therefore reach the lungs to a higher extent than the larger particles.

According to an advantageous embodiment of the invention, the first mass median aerodynamic diameter (FMMAD) is 0.1 to 5 micrometers, such as 0.1 to 4 micrometers, such as 0.1 to 3 micrometers, such as 0.1 to 2 micrometers, such as 0.1 to 1 micrometer.

According to an advantageous embodiment of the invention, the first mass median aerodynamic diameter (FMMAD) is 0.5 to 5 micrometers, such as 0.5 to 4 micrometers, such as 0.5 to 3 micrometers, such as 0.5 to 2 micrometers, such as 0.5 to 1 micrometer.

According to an advantageous embodiment of the invention, the second mass median aerodynamic diameter (SMMAD) is greater than 4 micrometers.

One advantage of the above embodiment may be that an adaptive delivery system may be obtained. By adapting the size of the aerosols, a higher degree of delivery of additives from the additive container to the oral cavity may be obtained. Especially, when the additive container comprise substances intended for delivery to the oral cavity, this may be a particular advantage. The larger aerosol particles may settle in the oral cavity to a higher extent than smaller aerosol particles.

In some example embodiments, the additive container may comprise flavoring. It may typically be intended that such flavorings are delivered to the oral cavity instead of in the lungs.

It has surprisingly been found that it may be possible, based on aerosol particle size variation, to successfully deliver actives and/or additives to target zones, such as the oral cavity or the lungs, whereby substances suitable for, for example, lung delivery, may be more efficiently delivered thereto, while, at the same time, additives suitable for, for example, delivery to the oral cavity, may settle to a great extent in the oral cavity and thereby delivery of such substances to the lungs may be minimized at least to some extent.

In some example embodiments, the additive container may comprise a pH-controlling agent, such as a buffering agent, for increasing the absorption of nicotine through the oral mucosa. Typically, a fraction of the nicotine from the nicotine container may end up in the oral cavity instead of the lungs, even when the nicotine-containing aerosols are adapted in size for lung delivery. Nicotine delivered to the oral cavity may typically be transported via saliva to the gastro-intestinal system, thereby contributing only very little to a desired rapid increase of nicotine concentration in the blood stream. However, if the nicotine is delivered via the oral cavity through the oral mucosa, some effect of the nicotine not reaching the lungs is obtained. Typical pH-levels of the oral cavity may not provide an effective uptake of nicotine through the oral mucosa. However, the additive of the additive container may comprise a pH-controlling agent, such as a buffering agent, for adjusting the pH-level in the oral cavity to improve nicotine absorption. Therefore, when the pH-controlling agent for adjusting the pH-level in the oral cavity is delivered by aerosols having a relatively large size intended for oral absorption, a selective delivery system may be obtained.

The present inventor surprisingly discovered that the effectiveness of delivering nicotine to a user with an ENDS may, according to embodiments of the invention, be improved by adding pH controlling agents to the nicotine solution comprised in the AC.

It has been found that embodiments of the invention increase the uptake of nicotine by a user by at least 2% or even 5%, such as 10% by weight of the total amount of nicotine delivered via the ENDS when compared to ENDS not utilizing pH-controlling agent.

Accordingly, it has also been established that embodiments of the invention may be used to deliver a target amount of nicotine to a user by using a lower nicotine concentration in the NC combined with pH-controlling agent in the AC, when compared to the nicotine concentration necessary to deliver the same target amount, but without pH-controlling agent.

The improved utilization of nicotine from the ENDS in these embodiments may be desirable for several reasons. For example, the cost of nicotine implies savings when using smaller amounts and the toxicity of the content in the NC may be lowered due to less nicotine content.

According to an advantageous embodiment of the invention, the second mass median aerodynamic diameter (SMMAD) is 4.01 to 100 micrometers, such as 4.01 to 50 micrometers, such as 4.01 to 30 micrometers, such as 4.01 to 20 micrometer.

According to an advantageous embodiment of the invention, the second mass median aerodynamic diameter (SMMAD) is 4.1 to 100 micrometers, such as 4.1 to 50 micrometers, such as 4.1 to 30 micrometers, such as 4.1 to 20 micrometers.

According to an embodiment of the invention, the second mass median aerodynamic diameter (SMMAD) is 5 to 100 micrometers, such as 5 to 50 micrometers, such as 5 to 30 micrometers, such as 5 to 20 micrometers.

According to an embodiment of the invention, the second mass median aerodynamic diameter (SMMAD) is 6 to 100 micrometers, such as 6 to 50 micrometers, such as 6 to 30 micrometers, such as 6 to 20 micrometers.

According to an embodiment of the invention, the second mass median aerodynamic diameter (SMMAD) is 7 to 100 micrometers, such as 7 to 50 micrometers, such as 7 to 30 micrometers, such as 7 to 20 micrometers.

According to an embodiment of the invention, the second mass median aerodynamic diameter (SMMAD) is 8 to 100 micrometers, such as 8 to 50 micrometers, such as 8 to 30 micrometers, such as 8 to 20 micrometers.

According to an embodiment of the invention, the second mass median aerodynamic diameter (SMMAD) is 9 to 100 micrometers, such as 9 to 50 micrometers, such as 9 to 30 micrometers, such as 9 to 20 micrometers.

According to an embodiment of the invention, the second mass median aerodynamic diameter (SMMAD) is 10 to 100 micrometers, such as 10 to 50 micrometers, such as 10 to 30 micrometers, such as 10 to 20 micrometers.

According to an advantageous embodiment of the invention, the geometric standard deviation (GSD) of the first mass median aerodynamic diameter is smaller than 10 micrometers, such as smaller than 8 micrometers, such as smaller than 6 micrometers, such as smaller than 4 micrometers, such as smaller than 2 micrometers, such as smaller than 1 micrometer.

According to an advantageous embodiment of the invention, the geometric standard deviation (GSD) of the second mass median aerodynamic diameter is smaller than 10 micrometers, such as smaller than 8 micrometers, such as smaller than 6 micrometers, such as smaller than 4 micrometers, such as smaller than 2 micrometers, such as smaller than 1 micrometer.

Typically, the aerodynamic diameter of the individual aerosol particles may deviate at least some from each other, i.e. the geometric standard deviation of the first and/or second mass median aerodynamic diameter may be at least e.g. 0.1 micrometer, such as at least 0.2 micrometer, such as at least 0.5 micrometer, such as at least 1 micrometer.

In some embodiments, the atomizers and/or other parts of the electronic nicotine delivery system may be designed to minimize the geometric standard deviation of the first and/or second mass median aerodynamic diameter. However, in certain alternative embodiments, it may be indented that the aerosols have different dimensions, i.e. the geometric standard deviation of the first and/or second mass median aerodynamic diameter has an increased minimum value.

Generally, the first and second mass median aerodynamic diameters (FMMAD, SMMAD) are each measured by a method according to the ISO 21501-1:2009(E) standard.

Generally, the first mass median aerodynamic diameter (FMMAD) is measured on the aerosols received from the electronic nicotine delivery system when only the first atomizer is activated.

Generally, the second mass median aerodynamic diameter (SMMAD) is measured on the aerosols received from the electronic nicotine delivery system when only the second atomizer is activated.

Generally, the first and second mass median aerodynamic diameters are each measured on an output of said electronic nicotine delivery system, the output being generated by a method according to the ISO 3308:2012(E) standard.

According to an advantageous embodiment of the invention, the first atomizer produces aerosols on basis of nicotine-solution received from the nicotine container and where the second atomizer produces aerosols on basis of additive/additive solution received from the additive container.

One advantage of the above embodiment may be that the two different kind of aerosols may be produced, one kind being nicotine-containing aerosols and the other kind being additive-containing aerosols, and that the two kind of aerosols may be directed to the lungs and the oral cavity, respectively, by means of different mass median aerodynamic diameters (MMAD) of the two kinds of aerosols.

According to an advantageous embodiment of the invention, the first mass median aerodynamic diameter (FMMAD) is established to facilitate transport of nicotine-containing aerosols to the lungs of a user of the electronic nicotine delivery system.

Preferably, according to the above embodiments, the first mass median aerodynamic diameter (FMMAD) is small enough to promote delivery of nicotine to the lungs.

According to an advantageous embodiment of the invention, the second mass median aerodynamic diameter (SMMAD) is established to facilitate uptake of the additive containing aerosols in the mouth of a user of the electronic nicotine delivery system.

Preferably, according to the above embodiments, the second mass median aerodynamic diameter (SMMAD) is large enough to promote delivery of additive to the oral cavity.

According to an advantageous embodiment of the invention, the nicotine solution comprises one or more pharmaceutically acceptable excipients or carriers.

In certain embodiments, it may be preferred to use excipients or carriers, which, when atomized are visible to the human eye, whereby they imitate the appearance of smoke from conventional cigarettes.

An example of such a carrier aiding in creating a visible aerosol may be propylene glycol.

According to an advantageous embodiment of the invention, the pharmaceutically acceptable excipients or carriers is chosen from the group consisting of water; terpenes, such as menthol; alcohols, such as ethanol, propylene glycol, polyethylene glycol, such as PEG 400, glycerol and other similar alcohols; dimethylformamide; dimethylacetamide; wax; supercritical carbon dioxide; dry ice; and mixtures or combinations thereof.

According to an advantageous embodiment of the invention, the pharmaceutically acceptable excipients or carriers comprise propylene glycol.

According to an advantageous embodiment of the invention, the pharmaceutically acceptable excipients or carriers comprise PEG 400.

According to an advantageous embodiment of the invention, the pharmaceutically acceptable excipients or carriers comprise glycerol.

One advantage of the above embodiment may be that an effective delivery of said nicotine and said additive while said aerosols may be provided to appear smoke-like. Thereby, the user of the electronic nicotine delivery system may perceive the usage of the electronic nicotine delivery system to resemble conventional smoking, which may be a significant advantage for a user trying to stop smoking.

According to an advantageous embodiment of the invention, said nicotine container comprises nicotine in an amount of 0.01-5% by weight of the nicotine solution, such as 0.1-5% by weight of the nicotine solution.

According to an advantageous embodiment of the invention, the solution in said nicotine container (NC) and/or said additive container (AC) comprises glycerol in an amount of 0-95% by weight, such as 0.01-95% by weight, such as 0.1-95% by weight.

According to an advantageous embodiment of the invention, the solution in said nicotine container and/or said additive container comprises propylene glycol in an amount of 0-95% by weight, such as 0.01-95% by weight, such as 0.1-95% by weight.

According to an advantageous embodiment of the invention, the solutions in said nicotine container and/or said additive container comprises 0.1-20% by weight of water, such as 0.1-15% by weight of water, such as 0-10% by weight of water, or such as 5-15% by weight of water.

According to an advantageous embodiment of the invention, the solution in said additive container comprises 0.01-10% by weight of flavoring, such as 0.01-5% by weight of flavoring, 0.01-0.5% by weight of flavoring.

According to an advantageous embodiment of the invention, the additive comprises one or more flavorings.

Typically, it may be desired that the user experiences one or more flavoring sensations when using the electronic nicotine delivery system. This may e.g. be done to mask the taste of nicotine. The flavorings may be designed to imitate a smoking experience of a conventional cigarette, or may be based on other flavorings, or may combine the two.

According to an advantageous embodiment of the invention, the one or more flavorings comprise almond, almond amaretto, apple, Bavarian cream, black cherry, black sesame seed, blueberry, brown sugar, bubblegum, butterscotch, cappuccino, caramel, caramel cappuccino, cheesecake (graham crust), cinnamon redhots, cotton candy, circus cotton candy, clove, coconut, coffee, clear coffee, double chocolate, energy cow, graham cracker, grape juice, green apple, Hawaiian punch, honey, Jamaican rum, Kentucky bourbon, kiwi, koolada, lemon, lemon lime, tobacco, maple syrup, maraschino cherry, marshmallow, menthol, milk chocolate, mocha, Mountain Dew, peanut butter, pecan, peppermint, raspberry, banana, ripe banana, root beer, RY 4, spearmint, strawberry, sweet cream, sweet tarts, sweetener, toasted almond, tobacco, tobacco blend, vanilla bean ice cream, vanilla cupcake, vanilla swirl, vanillin, waffle, Belgian waffle, watermelon, whipped cream, white chocolate, wintergreen, amaretto, banana cream, black walnut, blackberry, butter, butter rum, cherry, chocolate hazelnut, cinnamon roll, cola, creme de menthe, eggnog, English toffee, guava, lemonade, licorice, maple, mint chocolate chip, orange cream, peach, pina colada, pineapple, plum, pomegranate, pralines and cream, red licorice, salt water taffy, strawberry banana, strawberry kiwi, tropical punch, tutti frutti, vanilla, or any combination thereof.

A flavoring can be used to pair nicotine administration with certain gustatory and/or olfactory sensations. Subsequent administration of agent (e.g. nicotine) doses can be reduced while retaining the flavoring to help the user reduce their agent (e.g. nicotine) dependency.

According to an advantageous embodiment of the invention, the nicotine container and/or the additive container comprises pH-controlling agent.

In some embodiments pH-controlling agent in the nicotine container may be present to prevent or reduce vaporization of nicotine from the aerosols.

In some embodiments pH-controlling agent in the nicotine container may increase the absorption of nicotine through the oral mucosa.

According to an advantageous embodiment of the invention, said pH-controlling agent comprises a buffering agent.

In an embodiment of the invention, the content of said nicotine container and/or said additive container comprises pH-controlling agent, such as a buffering agent, in the amount of ½ to 5% by weight of the first and/or second component, such as 1 to 4%, such as 2 to 5%, such as 3 to 5%, such as 3 to 4%, such as 1 to 3%.

In an embodiment of the invention, the buffering agent is selected from the group consisting of a carbonate, including bicarbonate or sesquicarbonate, glycerinate, phosphate, glycerophosphate, acetate, glyconate or citrate of an alkali metal, such as potassium or sodium, e.g. trisodium and tripotassium citrate, or ammonium, tris buffer, amino acids, and mixtures thereof.

In an embodiment of the invention, the buffering agent comprises sodium carbonate, sodium bicarbonate or any combination thereof.

In an embodiment of the invention, the buffering agent comprises sodium carbonate, sodium bicarbonate or potassium carbonate.

According to a preferred embodiment of the invention, the buffering agent comprises sodium carbonate.

In connection to the above, it should be understood that said pH-controlling agent may advantageously be in the form of a liquid solution or suspension so as to facilitate the administration of said pH-controlling agent.

In an embodiment of the invention said oral cavity has a salivary pH that is above pKa of said pharmaceutically active ingredient.

According to an advantageous embodiment of the invention, the nicotine container and/or the additive container comprises pH-controlling agent having a non-salt form.

According to an advantageous embodiment of the invention, the additive container comprises nicotine.

According to one embodiment, the additive comprises substance for making smoke-like aerosols. Thereby, e.g. if the electronic nicotine delivery system comprises an electronic control setting a maximum nicotine delivery limit, the user may still experience a smoking sensation, at least to some degree, when nicotine-limit is reached by means of the smoke-like aerosols from the additive container.

According to an advantageous embodiment of the invention, the nicotine-containing aerosols comprise an acidic pH-controlling agent, such as an acidic buffering agent.

According to one embodiment, an acidic pH-controlling agent may be a substance for lowering the pH-value of an aqueous solution, such as water, having a pH of 7.0.

Examples of acidic pH-controlling agents may comprise citric acid based buffering agents, acetic acid based buffering agents.

According to an advantageous embodiment of the invention, the additive-containing aerosols comprise an alkaline pH-controlling agent, such as an alkaline buffering agent.

According to one embodiment, an alkaline pH-controlling may be a substance for increasing the pH-value of an aqueous solution, such as water, having a pH of 7.0.

Examples of alkaline pH-controlling agents may comprise buffering agents based on sodium carbonate, sodium bicarbonate, or potassium carbonate.

According to an advantageous embodiment of the invention, the nicotine-containing aerosols comprise a first pH-controlling agent and the additive-containing aerosols comprise a second pH-controlling agent, wherein the first pH-controlling agent is more acidic than the second pH-controlling agent.

Preferably, the above may be understood as when adding the pH-controlling agents to water, preferably with a pH-value of 7.0.

Therefore, according to the above, when the first pH-controlling agent is added to a first water sample, preferably with a pH-value of 7.0, and the second pH-controlling agent is added to a second water sample, preferably with a pH-value of 7.0, the first water sample with the added first pH-controlling agent has a lower pH-value than the second water sample with the added second pH-controlling agent.

According to an advantageous embodiment of the invention, at least one of the atomizers comprises a transport element and/or a heating element.

Contrary to every expectation, it has been established that a pH-controlling agent, such as a buffering agent, may even be incorporated into aerosols produced by means of a heating element without losing all the effect of the pH-controlling agent during the heating-invoked evaporation. Thus, it turns out that it is possible to evaporate the pH-controlling agent together with nicotine by means of a heater, thereby making it possible to apply in a heating-based delivery system. An important benefit of this is that it is now possible to apply more attractive and compact technologies for the delivery of nicotine.

In some embodiments, both the first and second atomizers may be provided with a transport element and a heating element. However, in other embodiments, only one atomizer is provided with a heating element, preferably the first atomizer producing nicotine-containing aerosols from the nicotine container, whereas the second atomizer may produce aerosols e.g. by using pressure and a nozzle.

In certain embodiments, the atomizer(s) may comprise only a heating element.

In certain embodiments, the atomizer(s) may comprise only a transport element.

According to an advantageous embodiment of the invention, the heating element is powered by current supplied by said power supply.

According to an advantageous embodiment of the invention, said transport element is an active transport element.

Examples of active transport elements may comprise pumps and setups involving an adjustable valve.

According to an advantageous embodiment of the invention, the transport element comprises a liquid pump.

According to various embodiments, the liquid pump, i.e. the pump for pumping liquid, may be a peristaltic pump, a plunger pump, an eccentric pump or a screw pump. Alternatively, the liquid pump can use piezoelectric pump, a super magnetostrictive pump, a thermal expansion drive pump, a thermal contraction drive pump, a thermal bubble pump, a positive displacement pump.

According to an advantageous embodiment of the invention, said transport element is a passive transport element.

Examples of passive transport elements may e.g. comprise a wick, or a capillary tube. One further example may be that the transport is facilitated by gravity.

According to an advantageous embodiment of the invention, the transport element comprises a wick.

According to an advantageous embodiment of the invention, the wick comprises silica fibers.

Wick materials may vary greatly from one atomizer to another, but silica fibers are preferred in many atomizers. However, other atomizers comprises wick made from silica, cotton, porous ceramic, hemp, bamboo yarn, oxidized stainless steel mesh, wire rope cables, or combinations thereof.

According to an advantageous embodiment of the invention, the transport element comprises a tube, such as a capillary tube.

According to an advantageous embodiment of the invention, the heating element comprises a resistance wire or plate arranged to heat and vaporize liquid dosed by the transport element.

According to an advantageous embodiment of the invention, at least one of the atomizers comprises an air flow regulator.

According to an advantageous embodiment of the invention, the airflow regulator is active.

Examples of active airflow regulators may e.g. include an adjustable valve.

According to an advantageous embodiment of the invention, the airflow regulator is passive.

Examples of passive airflow regulators may include orifices, openings or valves, including filters etc., which determines the air flow for a given pressure difference between the mouth piece and the one or more air inlets. Examples of passage airflow regulators may include one or more narrow passages restricting the air flow.

According to an advantageous embodiment of the invention, the first mass median aerodynamic diameter (FMMAD) is established by matching the applied nicotine solution with e.g. air flow rate, dose, current, resistance of heating element, duration of heating by the first atomizer, or composition of nicotine solution.

According to an advantageous embodiment of the invention, the second mass median aerodynamic diameter (SMMAD) is established by matching the applied additive with e.g. air flow rate, dose, current, resistance of heating element, duration of heat of the second atomizer, or composition of additive solution.

According to an advantageous embodiment of the invention, the heating power from the first atomizer is different from the heating power of the second atomizer.

Preferably, the difference may be at least 10% of the heating power of the first atomizer, such as at least 20% or at least 30%. The heating power should be understood as the electrical power lost in the heating element, i.e. the electrical power converted to heat.

According to an advantageous embodiment of the invention, the pharmaceutically acceptable excipients or carriers of the nicotine container is different from the pharmaceutically acceptable excipients or carriers of the additive container.

According to an advantageous embodiment of the invention, the combined vapor pressure of the excipients or carriers from the nicotine container is at least 10% higher than the combined vapor pressure of the excipients or carriers from the AC, when measured at 101325 Pa and 20° C.

By adjusting the vapor pressures of the carriers a way of adjusting aerosol particle size may be obtained in that higher vapor pressure may accelerate evaporation from the individual aerosol particles, whereby the size of the particles or droplets is diminished, while lower vapor pressures will diminish evaporation and promote larger size particles or droplets.

According to an advantageous embodiment of the invention, the weight of liquid dispensed from the nicotine container is different than the weight of liquid dispensed from the additive container.

Preferably, the difference may be at least 10% of the dose dispensed from the first atomizer, such as at least 20% or at least 30%.

According to an advantageous embodiment of the invention, the air flow velocity at the first atomizer is different than the air flow velocity at the second atomizer.

Preferably, the difference may be at least 10% of the air flow velocity at the first atomizer, such as at least 20% or at least 30%.

According to an advantageous embodiment of the invention, the atomizer arrangement delivers an output of a mixture of aerosols via the mouth pieces and wherein the mixture of aerosols comprises nicotine-containing aerosols having a first mass median aerodynamic diameter (FMMAD) and additive-containing aerosols having a second mass median aerodynamic diameter (SMMAD) and wherein the second mass median aerodynamic diameter (SMMAD) is greater than the first mass median aerodynamic diameter (FMMAD).

According to an advantageous embodiment of the invention, the nicotine container and/or additive container are replaceable.

One advantage of using exchangeable containers may be that a part of the electronic nicotine delivery system may be reusable, while the containers may be provided as sealed, tamper-proof containers so that the user may avoid coming into contact with the content of the containers.

Preferably, in some embodiments, the atomizers and/or the containers are provided with a liquid coupling for providing liquid communication between the respective container and the respective atomizer.

However, on other embodiments, the containers are replaceable together with the atomizers, preferably as a single cartridge.

According to an advantageous embodiment of the invention, the electronic nicotine delivery system comprises activation arrangement, such as an activation button and/or an air-flow sensor.

The air-flow sensor may detect if a user applies a reduced pressure (partial vacuum) to the mouth piece. Also, in some cases the air-flow sensor may detect the level of reduced pressure applied. In some cases the amount of nicotine and/or additive aerosolized may be adapted to the level of reduced pressure applied, e.g. by regulating the heat of the heating element, e.g. by regulating the current applied to the heating element.

According to an advantageous embodiment of the invention, the electronic nicotine delivery system comprises one more heating sensors for sensing heating by one or more heating elements.

The heating sensor may for example measure a parameter indicative of the electrical power dissipated from the one or more heating elements.

According to an advantageous embodiment of the invention, the electronic nicotine delivery system comprises a dose controller.

According to an advantageous embodiment of the invention, said dose controller is passive.

According to an advantageous embodiment of the invention, said dose controller is active.

According to an advantageous embodiment of the invention, the electronic nicotine delivery system comprises an aerosol particle size controller, such as a baffle, for controlling the aerosol particle size after the aerosol is formed.

According to an advantageous embodiment of the invention, the electronic nicotine delivery system is comprised in a handheld device.

According to an advantageous embodiment of the invention, the electronic nicotine delivery system comprises an electronic control arrangement for activating the first and second atomizers in a synchronized manner.

According to an embodiment, the nicotine container and the additive container may be provided together, e.g. as two adjacent compartments.

The invention relates in a second aspect to a method of producing a mixture of aerosols in an electronic nicotine delivery system comprising a mouthpiece, the method comprising the steps of establishing nicotine-containing aerosols having a first mass median aerodynamic diameter (FMMAD), establishing additive-containing aerosols having a second mass median aerodynamic diameter (SMMAD), the second mass median aerodynamic diameter (SMMAD) being greater than the first mass median aerodynamic diameter (FMMAD), and creating an output of a mixture of the nicotine-containing aerosols having a first mass median aerodynamic diameter (FMMAD) and additive-containing aerosols having a second mass median aerodynamic diameter (SMMAD) via the mouthpiece.

According to an advantageous embodiment of the invention, the method of the second aspect of the invention of producing a mixture of aerosols is applied to an electronic nicotine delivery system according the first aspect of the invention or any embodiment thereof.

The invention relates in a third aspect to an aerosol mixture comprising nicotine-containing aerosols having a first mass median aerodynamic diameter (FMMAD) and additive-containing aerosols having a second mass median aerodynamic diameter (SMMAD), wherein the second mass median aerodynamic diameter (SMMAD) is greater than the first mass median aerodynamic diameter (FMMAD).

According to an advantageous embodiment of the invention, the aerosol mixture of the third aspect of the invention is produced by an electronic nicotine delivery system (ENDS) of the first aspect of the invention of any embodiment thereof.

According to an advantageous embodiment of the invention, the aerosol mixture of the third aspect of the invention is produced by a method of the second aspect of the invention or any embodiment thereof.

The invention relates in a fourth aspect to use of an electronic nicotine delivery system for the production of an aerosol mixture, the aerosol mixture comprising nicotine-containing aerosols having a first mass median aerodynamic diameter (FMMAD) and additive-containing aerosols having a second mass median aerodynamic diameter (SMMAD), wherein the second mass median aerodynamic diameter (SMMAD) is greater than the first mass median aerodynamic diameter (FMMAD).

According to an advantageous embodiment of the invention, the use according to the fourth aspect of the invention is of an electronic nicotine cigarette system according to the first aspect of the invention or any embodiment thereof.

The pH value of saliva in the oral cavity is throughout the application referred to the below measuring procedure.

Ten representative users of the nicotine delivery system in question are delivering saliva to the test. Puff duration is chosen to be 3 seconds. The puff velocity is given as 20 ml/seconds given a puff volume of 60 ml.

The pH in the saliva is measured by collecting 1 ml of saliva from the users in individual vials after 10 puffs and the pH is measured with a calibrated pH meter within two minutes from collecting the saliva. The ten puffs are performed by the individual users within 5 minutes.

Saliva must not be swallowed at any time but shall be collected in plastic vials.

The average pH value obtained from these measurements is taken as the representative pH value for the given nicotine delivery system.

BRIEF DESCRIPTION OF THE DRAWINGS

The invention will be described in the following with reference to the figures in which.

DETAILED DESCRIPTION

Figure 1:
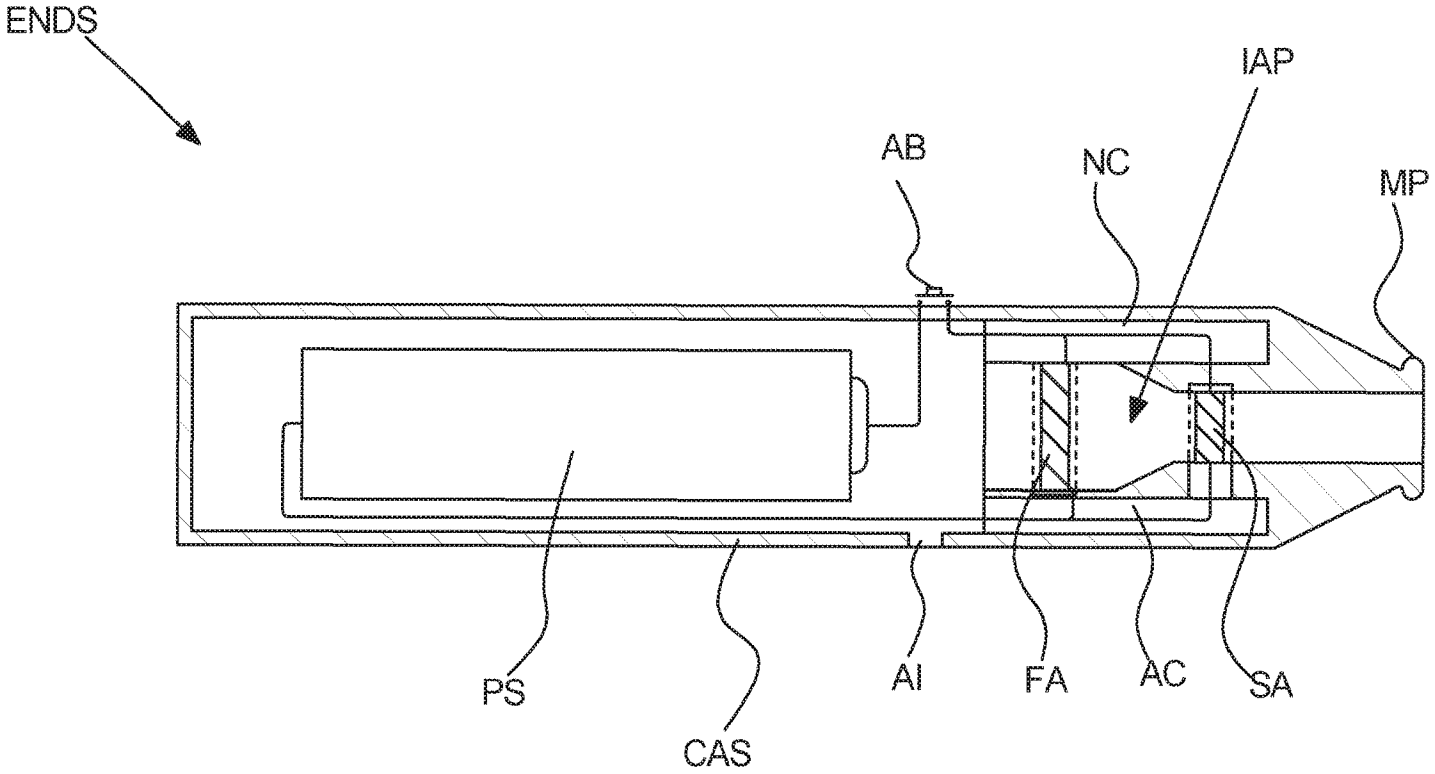
FIG. 1 illustrates an electronic nicotine delivery system according to an embodiment.

Referring to FIG. 1, an electronic nicotine delivery system ENDS is illustrated according to an embodiment of the invention. The electronic nicotine delivery system ENDS comprises a casing CAS for covering the individual parts of the electronic nicotine delivery system ENDS.

The casing CAS may be a single part, or may be assembled from two or more parts.

The electronic nicotine delivery system ENDS furthermore comprises a nicotine container NC, and additive container AC, and an atomizer arrangement AA. The atomizer arrangement AA comprises a first atomizer FA and a second atomizer SA.

The electronic nicotine delivery system ENDS furthermore comprises a mouth piece MP. The mouth piece MP is adapted for allowing a user of the electronic nicotine delivery system ENDS to apply a reduced pressure via the mouth to the electronic nicotine delivery system ENDS via suction at the mouth piece MP, i.e. when the user takes a drag or puff from the electronic nicotine delivery system ENDS similar to that from a conventional cigarette.

The casing CAS may preferably comprise one or more air inlets AI for supplying air to the atomizers FA, SA.

The atomizers FA, SA may preferably be positioned in an inner air passage IAP. The inner air passage IAP may preferably provide fluid communication from said one or more air inlets AI to said mouth piece MP inside said electronic nicotine delivery system ENDS. The atomizers FA, SA may in some embodiments be positioned in separate inner air passages IAP.

The mouth piece MP comprises an opening into the inner part of the electronic nicotine delivery system ENDS, that opening being in fluid communication via the inside of said electronic nicotine delivery system ENDS to the air inlet AI, and, optionally, additional air inlets AAI (not shown) through said inner air passage IAP.

The nicotine container NC and the additive container AC are positioned inside the casing CAS.

The nicotine container NC is connected to the first atomizer FA, while the additive container AC is connected to the second atomizer SA. Thereby, the content of the nicotine container NC and the content of the additive container AC are each allowed to move to the respective atomizer FA, SA to which it is connected. In some alternative embodiments the nicotine container NC may be connected to both atomizers FA, SA. In some alternative embodiments the additive container AC is connected to both atomizers FA, SA.

Inside the casing CAS, a power source PS, such as a battery, is arranged. The power source PS is electrically connected to the first and second atomizers FA, SA so as to power the atomizers FA, SA when these are activated. In this embodiment the first and second atomizers FA, SA are each shown comprising a transport element TE being a wick in fluid communication with the respective container NC, AC and a heating element HE being a coil for heating and atomizing, when the respective atomizer FA, SA is activated. In alternative embodiments the atomizers FA, SA may comprise additional and/or alternative elements.

The transport element TE may in other embodiments be other than a wick.

The heating element HE may in other embodiments be other than a coil.

In this embodiments the electronic nicotine delivery system ENDS comprises an activation button AB for activating the first and second atomizers FA, SA. However, in alternative embodiments, the electronic nicotine delivery system ENDS may comprise other arrangements for activating the atomizers FA, SA. For example, the electronic nicotine delivery system ENDS may comprise an air flow sensor AFS for detecting when a user applied a mouth generated reduced pressure to the mouth piece MP. This is illustrated on FIG. 5.

Returning to FIG. 1, the mouth piece MP may in some embodiments be detachable from the rest of the electronic nicotine delivery system ENDS, e.g. by means of threaded connections.

The nicotine container NC and/or the additive container AC may in some embodiments be removable and replaceable, preferably as a single cartridge, e.g. by removing the mouth piece MP and sliding the containers out by that end.

In some embodiments the atomizers FA, SA are connected to the containers NC, AC and thereby removed together with the containers NC, AC, e.g. as a single cartridge. However, in other embodiments, the containers NC, AC may be removed without the atomizers FA, SA, e.g. as a single cartridge.

In the following, electronic nicotine delivery systems ENDS according to various embodiments of the invention are illustrated. The electronic nicotine delivery systems ENDS of the following embodiments may comprise one or more elements similar to the elements described above. The electronic nicotine delivery systems ENDS of the following embodiments may comprise one or more elements additional or alternative to the elements described above.

Electrical connections are shown in the figures for illustrative purposes and may for practical purposes be arranged and positioned differently.

In an alternative embodiment, the aerosol particle size may be controlled by means of the heating from the heating element HE, such as the coil. When using heating elements HE with resistive heating, the heating may be controlled by varying the electrical power loss in the heating element, i.e. the electrical power converted to heat, which may again be controlled by controlling the resistance and the voltage applied.

Typically, it may be seen that by increasing the applied heating, the aerosol particle size decreases.

In a further alternative embodiment, the aerosol particle size may be controlled by adjusting the composition of the content of the nicotine container NC and the additive container AC.

Typically, it may be seen that by using a more volatile liquid, the aerosol particle size decreases.

Furthermore, in many embodiments of the invention, the electronic nicotine delivery system comprises an electrical control arrangement ECA. The electronic control arrangement ECA may comprise several co-operating different units, it may be comprised in one housing or it may even be integrated into other units, e.g. the power supply. The electronic control arrangement ECA is electrically connected to the atomizers and the activation arrangement, such as an activation button and/or an air flow sensor.

The electronic control arrangement ECA is arranged to controls the effective dose delivered by the atomizer on the basis of an automatic regulation of the electrical power supplied to the atomizer AT by the power supply PS and/or the activation time.

Furthermore, the electronic control arrangement ECA may in some embodiments be adapted to control the activation of the first and second atomizers in a synchronized manner. In some embodiments, electronic control arrangement ECA may impose a delay of a predetermined period of time between the activation of the first and second atomizers.

Furthermore, the electronic control arrangement ECA may in some embodiments be adapted to control the dose supplied to the first and/or second atomizer FA, SA.

Furthermore, the electronic control arrangement ECA may in some embodiments be adapted to control the aerosol particle size of the aerosols produced by the first and/or second atomizer FA, SA.

Figure 2A:
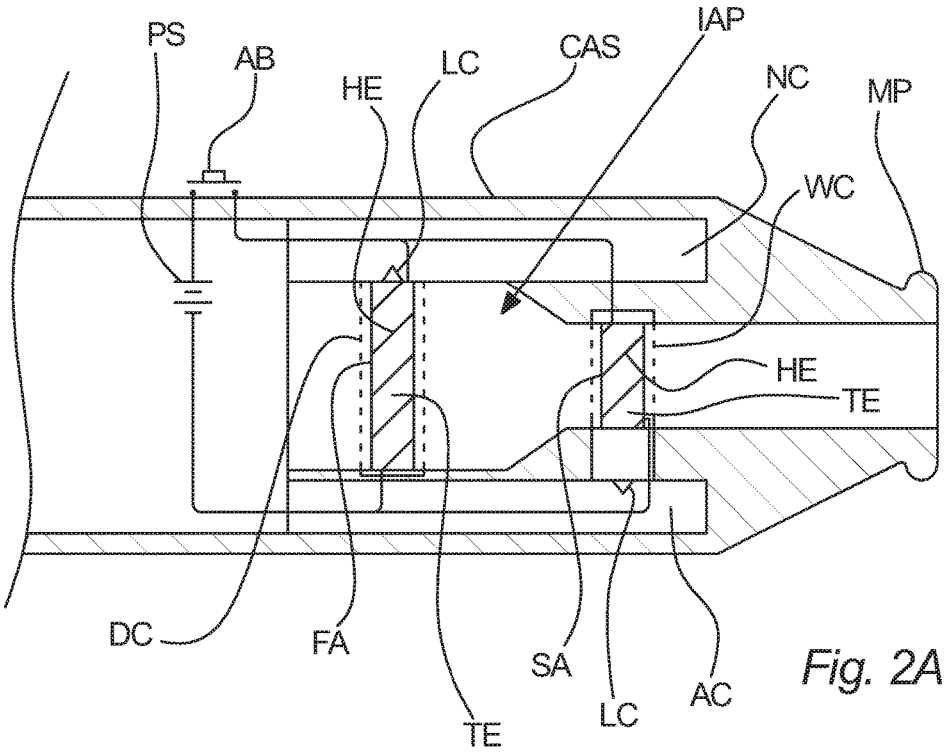
FIG. 2A illustrates a part of an electronic nicotine delivery system according to an embodiment.
Figure 2B:
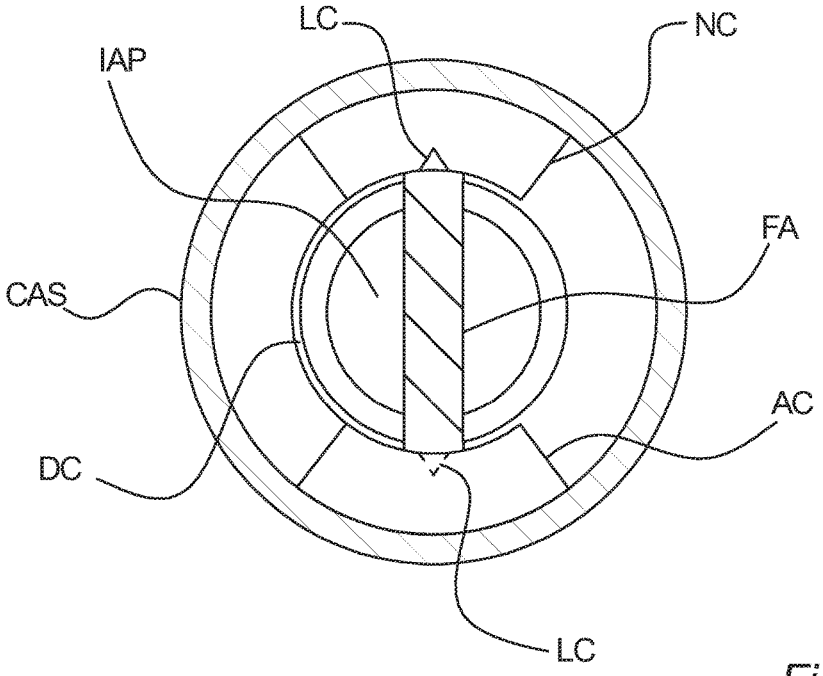
FIG. 2B illustrates a part of an electronic nicotine delivery system according to an embodiment.

Referring to FIGS. 2A and 2B, a part of an electronic nicotine delivery system ENDS is illustrated according to an embodiment of the invention. FIG. 2A illustrates a partially cross-sectional side view, whereas FIG. 2B illustrates a cross-sectional end view, as seen from the left towards the right on FIG. 2A.

The electronic nicotine delivery system ENDS of the present embodiment may be built up similar to the embodiment illustrated on FIG. 1, but is shown in more detail of FIGS. 2A and 2B.

The first and second atomizers are longitudinally displaced inside the inner air passage IAP such that the diameter of the inner air passage IAP is different at each atomizer FA, SA. Thereby, since the total flow rate is constant over the inner air passage IAP, the flow velocity at the first atomizer FA is lower that the flow velocity at the second atomizer SA, due to the cross-sectional flow area being smaller at the second atomizer SA compared to at the first atomizer FA.

The first and second atomizers FA, SA are in this embodiment illustrated having a transport element TE being a wick and a heating element HE being a coil arranged around a part of the wick. When the coil is heated, it provides resistive heating by means of a power source PS. In alternative embodiments the atomizers FA, SA may comprise additional and/or alternative elements. In some alternative embodiments, the heating element HE may be e.g. a plate or a tube, heated e.g. by resistive heating. In some alternative embodiments, the transport element TE may comprise e.g. a tube, such as a capillary tube, and/or may comprise a pump, such as an electronic pump.

Moreover FIG. 2B illustrates that nicotine container NC and the additive container AC each are positioned about the inner air passage IAP in which the atomizers FA, SA are positioned.

Preferably, as illustrated, the wick of the first atomizer FA is in fluid communication with the nicotine container NC. Preferably, both ends of each wick are in fluid communication with their respective containers. This may be facilitated by the first atomizer FA comprising a distribution conduit DC providing fluid communication from the end of the wick disposed near the nicotine container NC to the opposite end. The second atomizer may be constructed in a similar way.

Each atomizer FA, SA may comprise a distribution conduit DC for transporting the content of the respective container NC, AC to the end of the wick facing away from the respective container NC, AC. Thereby, a more uniform wetting, or distribution of the container content over the length of the wick may be obtained. Also, a faster transport of container content to and throughout the wick after one activation of the respective atomizer FA, SA to the next activation may be obtained, i.e. a faster reload after the user activates one or both atomizers FA, SA.

The electronic nicotine delivery system ENDS may furthermore comprise a liquid coupling LC for coupling liquid from the nicotine container NC or the additive container AC to the first and second atomizers FA, SA, respectively. The liquid coupling may in some embodiments be arranged to pierce a part of the relevant container NC, AC to provide access and liquid communication from the inside of the respective container NC, AC to the outside of that container NC, AC.

In FIGS. 2A and 2B the wicks of the first and second atomizers FA, SA are shown as substantially parallel, which is why the second atomizer SA is hidden behind the first atomizer FA in FIG. 2B. However, in other embodiments, the two atomizers FA, SA may be oriented with an angle relative to each other, when seen from the end as in FIG. 2B, e.g. 90° (degrees).

Figure 3A:
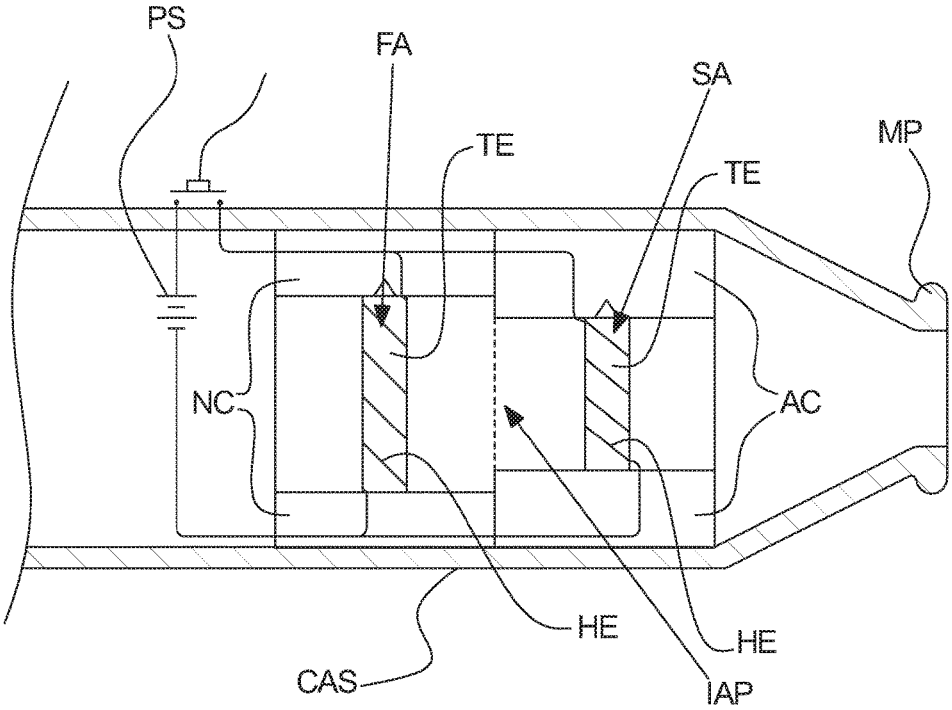
FIG. 3A illustrates a part of an electronic nicotine delivery system according to an embodiment.
Figure 3B:
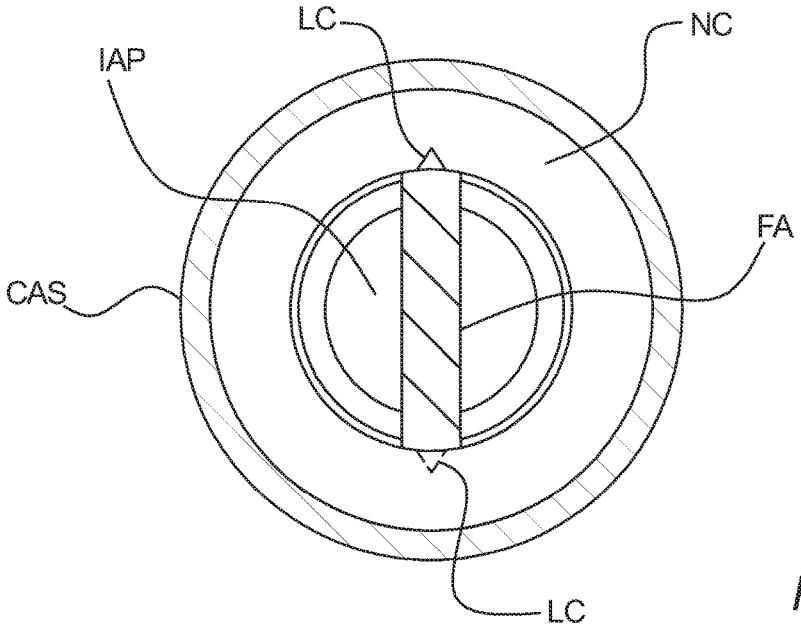
FIG. 3B illustrates a part of an electronic nicotine delivery system according to an embodiment.

Now referring to FIGS. 3A and 3B, an embodiment of the invention is illustrated. FIG. 3A illustrates a partially cross-sectional side view, whereas FIG. 3B illustrates a cross-sectional end view, as seen from the left towards the right on FIG. 3A.

The present embodiment may be an alternative to the embodiment illustrated on FIG. 2, but may comprise some of the elements described in relation therewith and/or with FIG. 1.

One difference between the embodiment of FIGS. 2 and 3 is that the nicotine container NC and the additive container AC of FIGS. 3A and 3B both completely encircle their respective atomizer FA, SA to form cylindrical shell-shaped containers, whereas on FIG. 2, the containers each extended along both atomizers FA, SA, but were disposed at different sides, i.e. each only partially encircling the atomizers FA, SA. The complete encirclement is best illustrated on FIG. 3B, where the nicotine container NC can be seen to enclose the first atomizer FA. Similarly, the additive container AC (not shown on FIG. 3B) completely encircles the second atomizer SA (not shown on FIG. 3B).

As illustrated on FIG. 3A, it is possible to control the air flow velocity at each atomizer FA, SA by varying the cross-sectional area of the inner air passage IAP, i.e. by having different cross-sectional areas at each atomizer FA, SA, the air flow velocity at each atomizer FA, SA is different, due to the flow rate being the same (common inner air passage IAP).

Figure 4A:
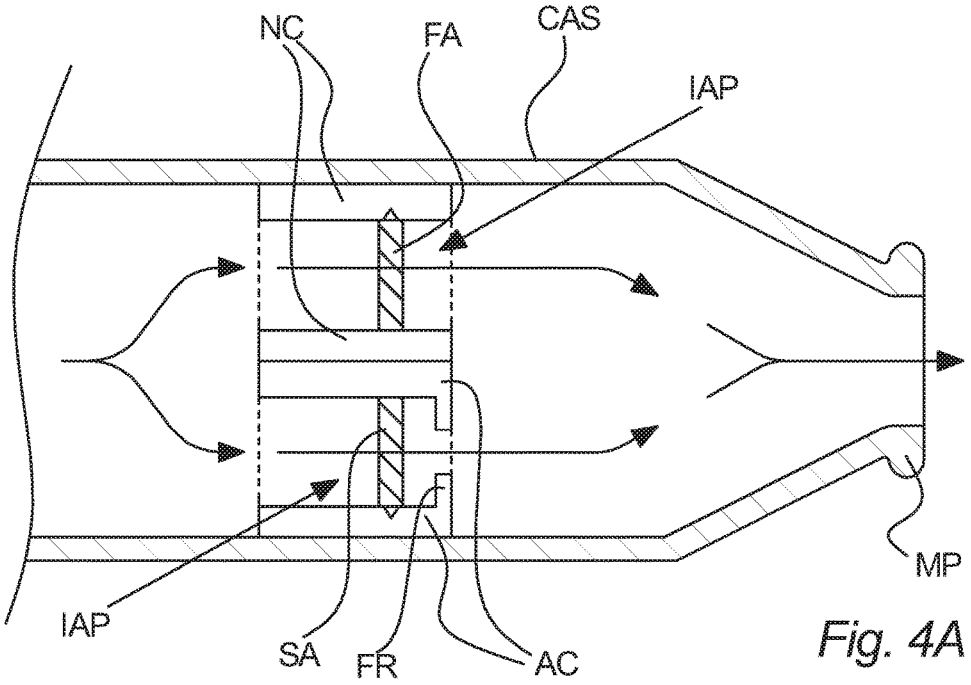
FIG. 4A illustrates a part of an electronic nicotine delivery system according to an embodiment.

Referring to FIG. 4A, a part of an electronic nicotine delivery system ENDS according to an embodiment of the invention is illustrated.

The present embodiment is an alternative to the embodiments illustrated in relation to FIGS. 2 and 3.

The electronic nicotine delivery system ENDS comprises a first and a second atomizer FA, SA. The first and second atomizers FA, SA are in this embodiment positioned in parallel; opposite the serial positioning of e.g. FIGS. 2 and 3, i.e. in the embodiment of FIG. 4A, each atomizer FA, SA is positioned in a separate inner air passages IAP. As illustrated the inner air passage IAP of the second atomizer SA has a flow regulator FR in the form of a narrowed outlet partially obstructing the air flow. Thereby, the flow rate of the two inner air passages IAP is different, and, due to the cross-sectional are at the wick being substantially the same for the two atomizers FA, SA, the flow velocity at the first atomizer FA will be higher than the flow velocity of the second atomizer SA.

In other embodiments, the inner air passage IAP of the first atomizer FA or the inner flow passage IAP of both atomizers FA, SA may comprise a flow regulator FR.

By controlling the flow velocity at the atomizer, the size of the aerosols from that atomizer may be controlled, at least to some degree. Therefore, by controlling the flow velocity differently and independently for each atomizer FA, SA, the aerosol particle size from may be controlled differently and independently for each atomizer FA, SA. By controlling the aerosol particle size for the content of the nicotine container NC and the additive container AC, respectively, the content of the each container NC, AC may be, at least to some degree, be targeted towards uptake via the oral cavity or via the lungs.

In an alternative embodiment, the narrowing of the inner air passage IAP may be positioned e.g. at the beginning of the inner air passage IAP.

Figure 4B:
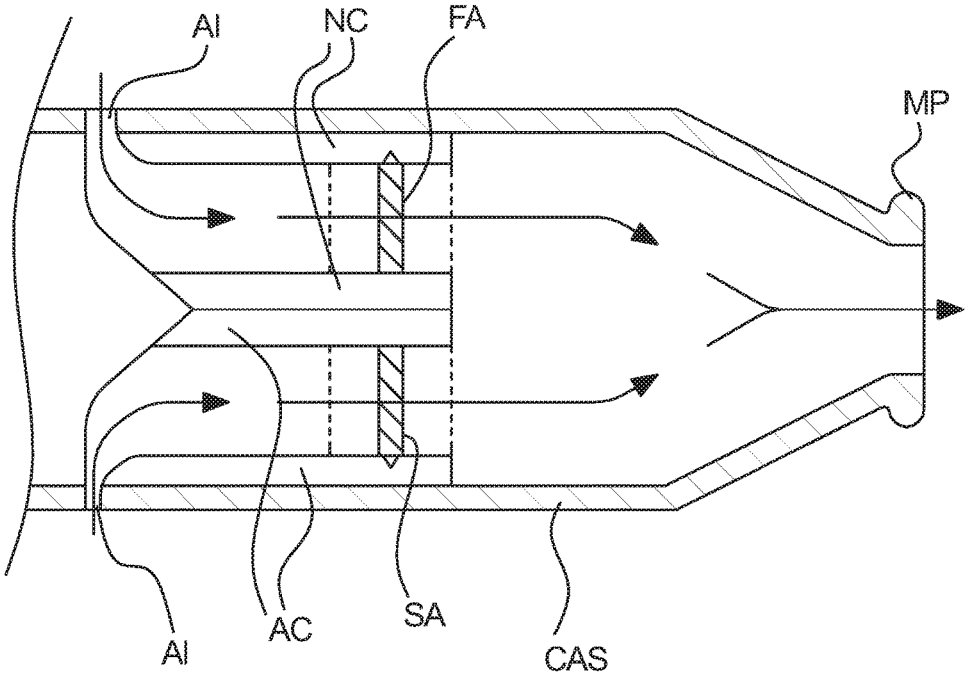
FIG. 4B illustrates a part of an electronic nicotine delivery system according to an embodiment.

Referring to FIG. 4B, an alternative to the embodiment of FIG. 4A is shown. In FIG. 4A, the first and second atomizers FA, SA share the air inlet (not shown), whereas in FIG. 4B, each atomizer has a separate air inlet AI. Thereby, the flow rate, and consequently the flow velocity, may be controlled separately and independently for each atomizer FA, SA. This illustrates that separate and independent control of the air flow for each atomizer FA, SA may be realized in various ways.

Figure 5:
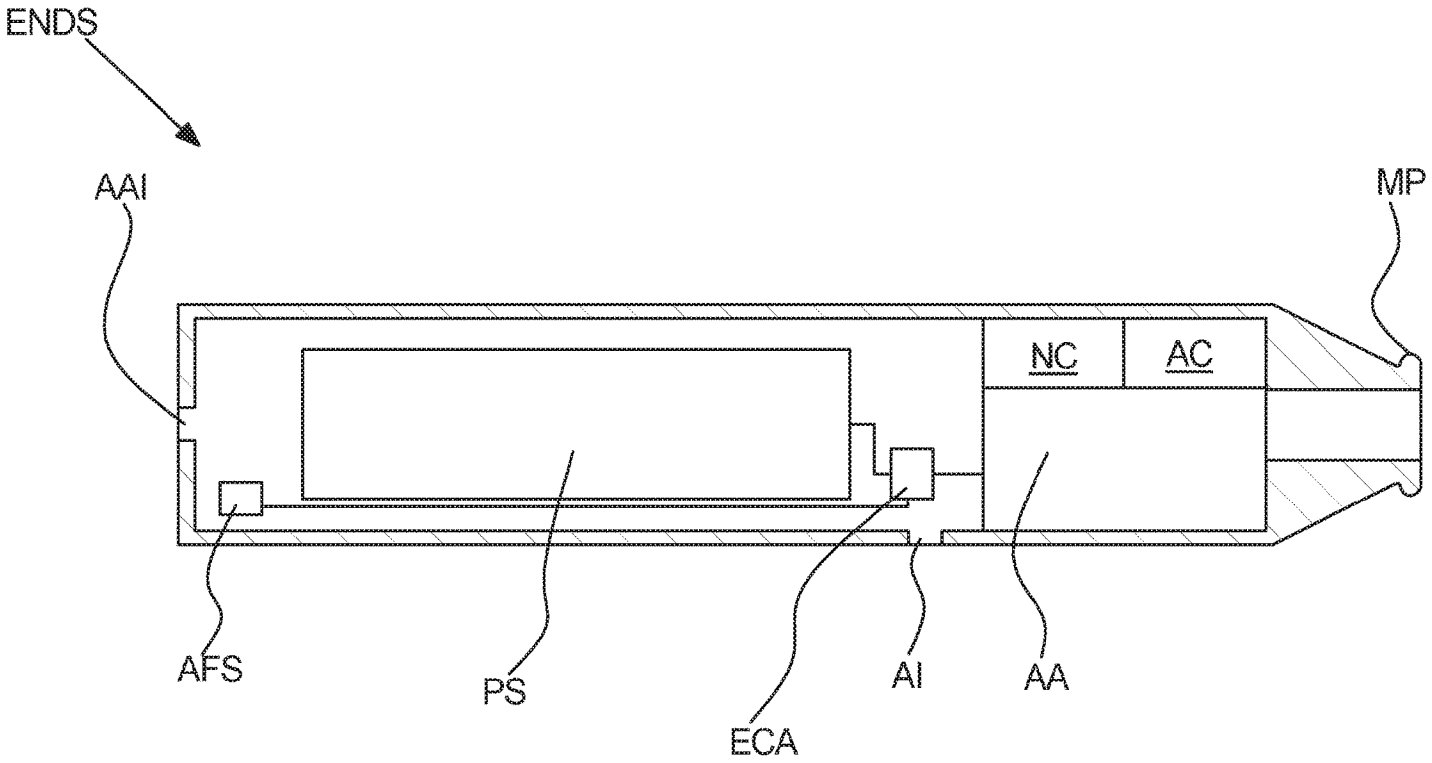
FIG. 5 illustrates an electronic nicotine delivery system according to an embodiment.

Now, referring to FIG. 5 an electronic nicotine delivery system ENDS is illustrated according to a further embodiment of the invention. The electronic nicotine delivery system ENDS comprises a casing CAS with a mouth piece MP, a power source PS, such as a battery, an air flow sensor AFS, an electronic control arrangement ECA, an atomizer arrangement AA, a nicotine container NC, and an additive container AC. The casing CAS comprises an air inlet AI and an additional air inlet. Each air inlet AI, AAI is in fluid communication mouth piece MP through the inside of the electronic nicotine delivery system ENDS so as to provide air when a user applies a reduced pressure to the mouth piece MP.

The atomizer arrangement AA may be arranged according to any of the embodiments described in relation to the aforementioned figures.

In some embodiments the air inlet AI is the primary air inlet, providing e.g. at least 70% of the air, such as at least 80%, such as at least 90%, such as at least 95%.

The air flow sensor AFS may be positioned near the additional air inlet AAI so as to detect air flow through the additional air inlet AAI, which is indicative of a user applying a reduced pressure to the mouth piece MP. Alternatively, the air flow sensor AFS may be positioned air inlet AI, whereby the additional air inlet AAI in some cases may be disposed of When the air flow sensor AFS detects air flow, it sends a signal to the electronic control arrangement ECA which activates the atomizer arrangement AA, e.g. by activating the power to the atomizer arrangement AA.

Thereby, when the user applies a reduced pressure to the mouth piece MP, the atomizer arrangement AA may be automatically activated.

In some embodiments, the electronic nicotine delivery system ENDS may further to the air flow sensor AFS comprise an activation button (not shown). In such cases, the activation button AB may be used to determine the dose delivered from the nicotine container NC and/or the additive container AC, e.g. determined from the temporal length of the button activation. Alternatively, the strength of the reduced pressure applied to the mouth piece MP and detected by the air flow sensor AFS may determine the dose delivered from the nicotine and/or the additive container.

In a further embodiment, only one atomizer FA, SA is activated automatically by means of the air flow sensor AFS, whereas the other atomizer FA, SA must be activated by the activation button AB. Preferably, it may be the first atomizer FA connected to the nicotine container NC that must be activated via the activation button AB.

The present embodiment may be employed on connection with container and atomizer designs illustrated on FIGS. 1-4.

Figure 6:
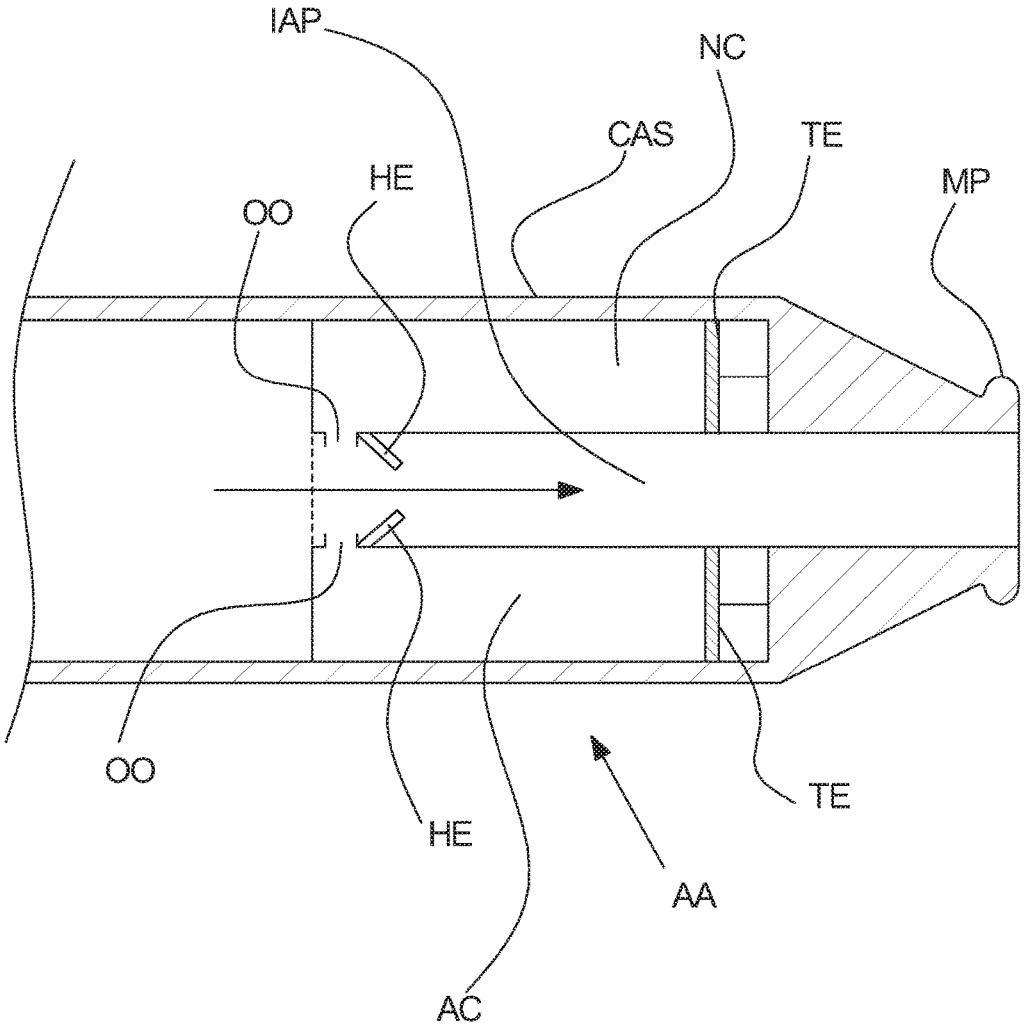
FIG. 6 illustrates a part of an electronic nicotine delivery system according to an embodiment.

Now referring to FIG. 6, a part of an electronic nicotine delivery system ENDS according to a further embodiment of the invention is illustrated.

The present embodiment is an alternative to the embodiments illustrated in relation with FIGS. 2-4 where the transport element TE is shown as a wick.

In the embodiment of FIG. 6, each atomizer FA, SA of the atomizer arrangement AA comprises a transport element TE and a heating element HE. The transport element TE of the present embodiment is shown as a pump comprising a piston displacing the content of the container NC, AC as the piston moves through the container NC, AC. Other pump types may be used in alternative embodiments, and the pump may be positioned outside the respective container NC, AC, e.g. on a tube or pipe between the container NC, AC and an output opening OO.

The content of the respective container NC, AC, such as a liquid composition, may be dispensed from the respective container NC, AC through an output opening OO on the respective container NC, AC. Due to an air flow as indicated the content of the respective container NC, AC is forced, as illustrated on FIG. 6, in a direction corresponding to from left to right on FIG. 6, and onto the respective heating element HE, where it is aerosolized.

In some embodiments the inner air passage IAP may be partitioned along a at least a part of its longitudinal length, and may provide for different air flow velocities at each heating element HE, similar to the design illustrated on FIGS. 4A and 4B. However in other embodiments, the output opening OO of the nicotine container NC and/or the additive container AC may be fitted with a tube or other transport element for transporting the content of the respective container NC, AC to a different longitudinal position, so as to obtain a design where the heating element HE of the first atomizer FA (atomizing the content of the nicotine container NC) has a different longitudinal position than the heating element HE of the second atomizer SA (atomizing the content of the additive container AC). Thereby different cross-sectional areas of the inner air passage IAP may be used to establish different air flow velocities for each atomizer FA, SA, similar to the design of FIGS. 2 and 3.

Figure 7A:
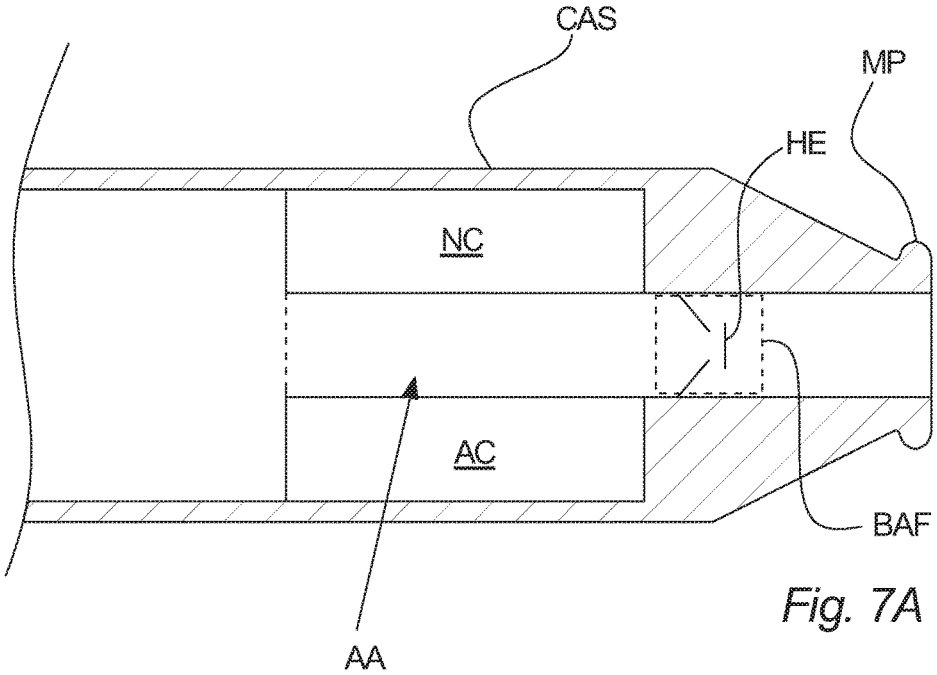
FIG. 7A illustrates a part of an electronic nicotine delivery system according to an embodiment.

Now referring to FIG. 7A, a further embodiment of the invention is illustrated. The electronic nicotine delivery system ENDS may comprise a baffle BAF, positioned after the atomizer arrangement AA.

The baffle BAF may comprise a heating element HE for heating and atomizing larger droplets. Thereby, the baffle BAF may decrease the average aerosol particle size.

The baffle BAF shown on FIG. 7A is common for the output of the first and second atomizers FA, SA.

In some embodiments one or more further baffles BAF may be employed. For example, for embodiments where the first and second atomizers FA, SA have different longitudinal positions, an additional baffle BAF may be positioned between the two atomizers FA, SA.

Figure 7B:
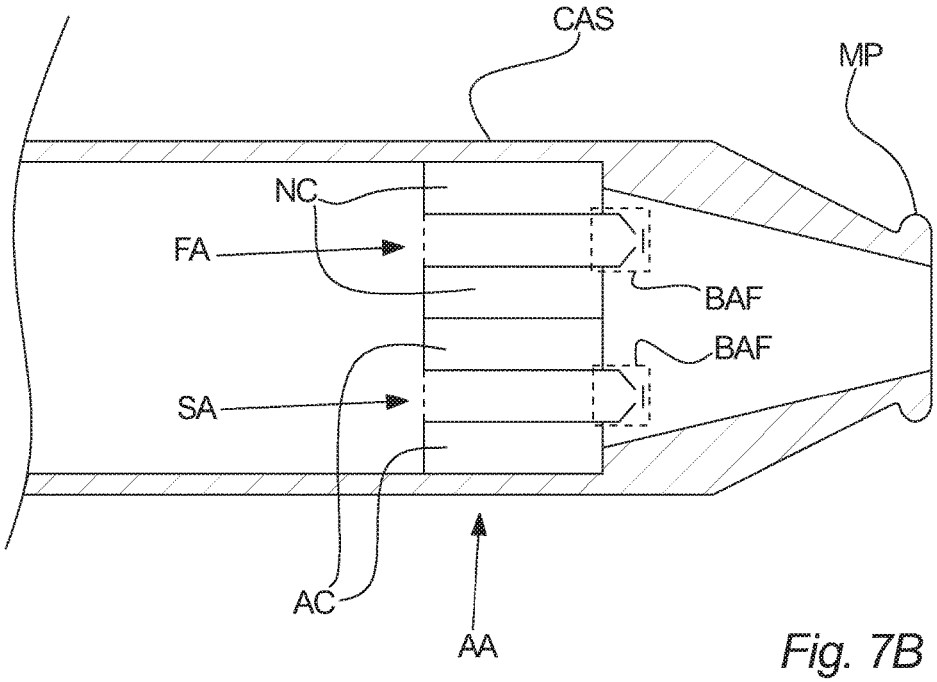
FIG. 7B illustrates a part of an electronic nicotine delivery system according to an embodiment.

According to the embodiment illustrated on FIG. 7B, the first and second atomizers FA, SA may be positioned in separate inner air passage IAP.

A baffle BAF may be positioned in relation to the output of each atomizer FA, SA, e.g. at the end of the inner air passage IAP, as shown.

One of both of the baffles BAF may comprise a heating element.

In some embodiments, the baffles BAF may contribute to controlling the aerosol particle sizes of the outputs of the first and second atomizers FA, SA. I.e. the baffles BAF may in some embodiments contribute to increasing the aerosol particle size difference between the outputs of the two atomizers FA, SA.

In some embodiments, the baffles BAF may fully control the aerosol particle sizes of the outputs of the first and second atomizers FA, SA.

Figure 8:
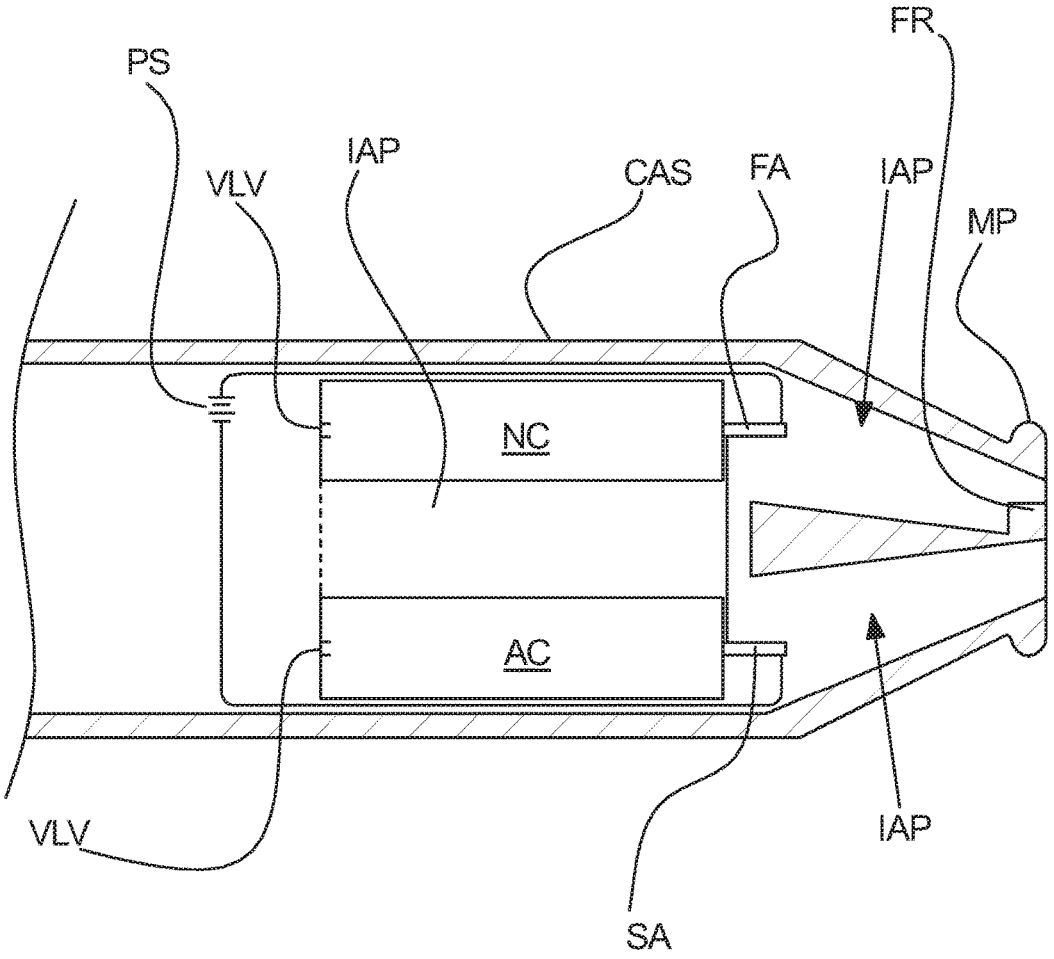
FIG. 8 illustrates a part of an electronic nicotine delivery system according to an embodiment.

Referring now to FIG. 8 a further embodiment of the invention is illustrated. The present embodiment comprises an alternative atomizer design compared to embodiments of the previous figures.

The nicotine container NC is fitted with first atomizer comprising an output tube facing towards the mouth piece MP. By means of a power sources PS, such as a battery, a voltage may be applied over at least a part of the length of the output tube, whereby the output tube may be heated by means of resistive heating.

The output tube may automatically draw the content of the nicotine container NC, e.g. by means of the capillary force. Thereby, the transport of the content of the nicotine container NC may be passive.

The output tube may in some embodiments comprise an inner wick extending at least along a part of the length of the output tube.

Alternatively, the first atomizer FA may be fitted with an active transporting arrangement such as a pump.

The second atomizer SA connected to the additive container AC may be constructed in a similar way as the first atomizer FA.

Furthermore, the output of the atomizers FA, SA may be lead to the mouth piece MP by separate inner air passage TAP. For example, designing the inner air passage TAP differently, as shown on FIG. 8, the flow velocity at the first and second atomizers FA, SA may be controlled independently, similar to the principles illustrated in relation to FIGS. 4A and 4B.

The nicotine container NC and the additive container AC may preferably each comprise a valve VLV for allowing air into the respective container NC, AC thereby avoiding creating a reduced pressure in the containers NC, AC as a result of dispensing of their content.

Figure 9:
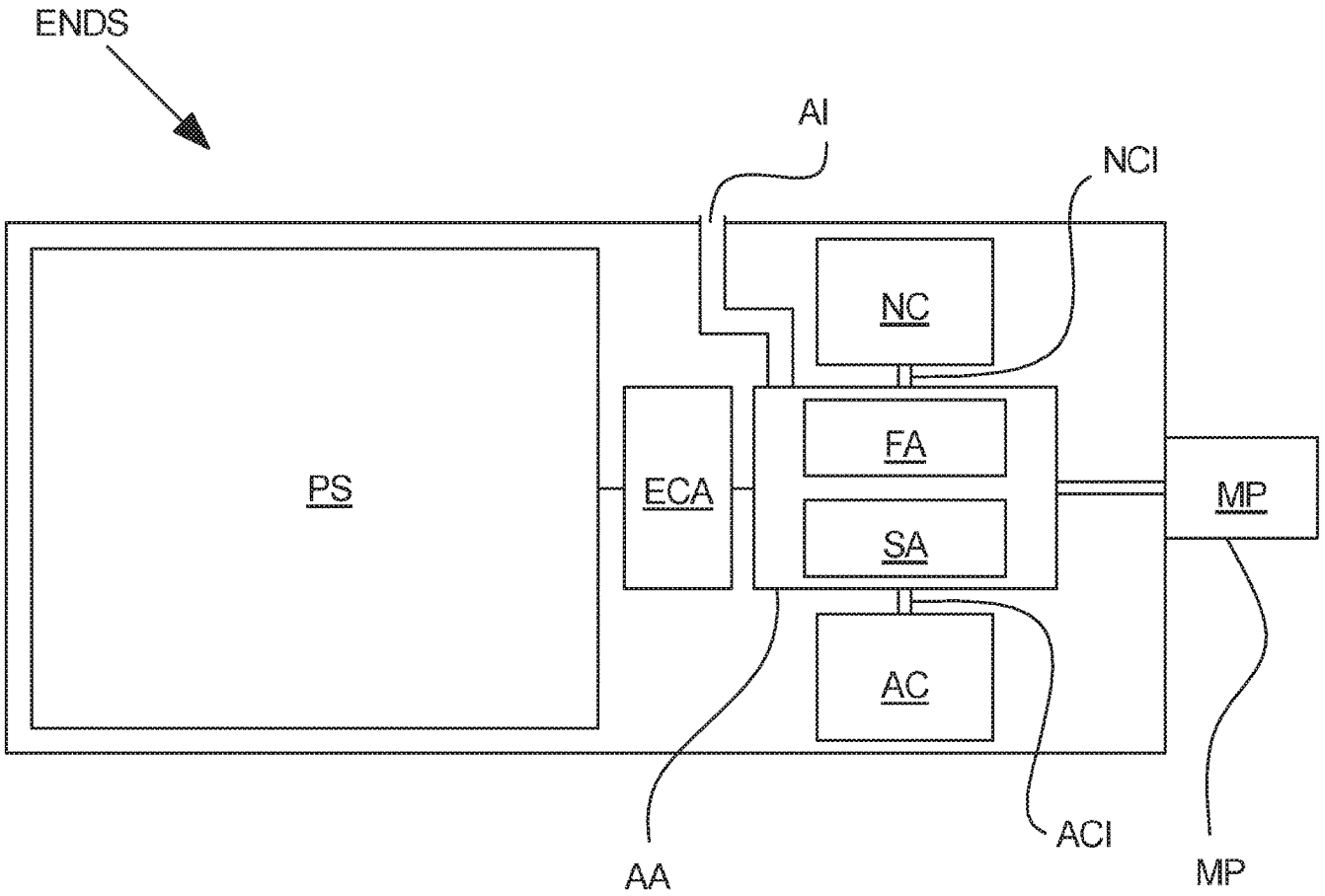
FIG. 9 illustrates an electronic nicotine delivery system according to an embodiment.

Now referring to FIG. 9, an electronic nicotine delivery system ENDS according to a further embodiment of the invention is illustrated.

The electronic nicotine delivery system ENDS comprises a power supply PS, such as a battery. Typically, the power supply PS may take up a substantial part of the electronic nicotine delivery system ENDS.

The electronic nicotine delivery system ENDS furthermore comprises an atomizer arrangement AA, which comprises a first atomizer FA and a second atomizer SA. The atomizers FA, SA are electrically connected to the power supply PS. The atomizers FA, SA may be constructed similar to the aforementioned embodiments illustrated on FIGS. 1-8. The first second atomizer FA may preferably be constructed in substantially the same way as the second atomizer SA.

The electronic nicotine delivery system ENDS furthermore comprises a nicotine container NC and an additive container AC.

The atomizer arrangement AA comprises an inlet NCI from the nicotine container NC and an inlet ACI from the additive container AC.

The electronic nicotine delivery system ENDS furthermore comprises a mouth piece MP for a user to apply an orally generated reduced pressure to and for the user to received aerosolized content of the nicotine container NC and/or the additive container AC. The mouth piece MP is in fluid communication with the atomizers FA, SA inside said electronic nicotine delivery system ENDS for facilitating transport of aerosols from the atomizers FA, SA.

The electronic nicotine delivery system ENDS may furthermore comprise one or more air inlets AI. The air inlet AI is in fluid communication with the atomizer arrangement AA inside the electronic nicotine delivery system ENDS, thereby facilitating transport of air from the air inlet AI to the atomizer arrangement AA.

The electronic nicotine delivery system ENDS may furthermore comprise an electronic control arrangement ECA.

The electronic control arrangement may preferably be powered by the power supply PS.

The electronic control arrangement ECA may control the activation of the atomizers FA, SA based on inputs from a user of the electronic nicotine delivery system ENDS. Such user inputs may comprise a signal from an activation button (not shown) activated by the user and/or detection of user application of orally generated reduced pressure to the mouth piece MP, e.g. by means of an air flow sensor AFS (not shown).

The electronic control arrangement ECA may activate the first and second atomizer FA, SA simultaneously, or delay the activation of the first or second atomizer FA, SA relative to the other atomizer FA, SA with a predetermined period of time.

The electronic control arrangement ECA may activate the first and second atomizer FA, SA for approximately the same period of time, or extend the activation of the first or second atomizer FA, SA if needed.

Figure 10A:
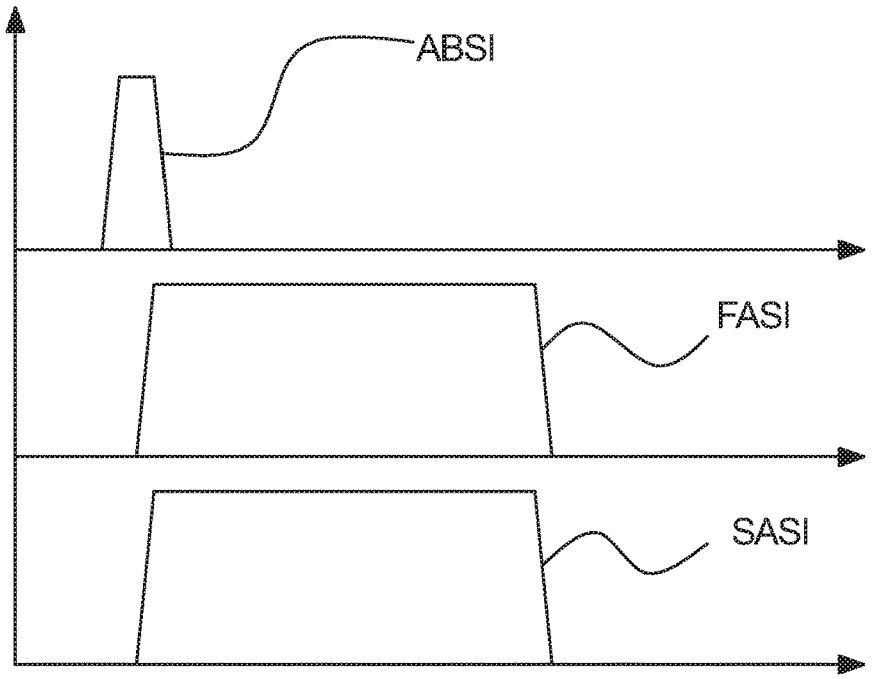
FIG. 10A-10B illustrate the timing of dispensing of components from an electronic nicotine delivery system according to different embodiments.

Now referring to FIG. 10A an embodiment of the invention is illustrated. FIG. 10A illustrates an activation button signal ABSI received by the electronic control arrangement ECA as a response to a user activating the activation button AB.

In response to the received a button signal ABSI, the electronic control arrangement ECA activates the first and second atomizer FA, SA, here illustrated by a first atomizer activation signal FASI and a second atomizer activation signal SASI.

The first atomizer signal FASI and/or the second atomizer signal SASI may in some embodiments be an electronic powering signal powering the transport element TE and/or the heating element HE of the respective atomizer FA, SA.

In one embodiment, the first atomizer activation signal FASI and the second atomizer activation signal SASI may illustrate the current through the heating elements HE, of the first and second atomizers FA, SA, respectively.

The atomizers FA, SA are activated for a predetermined period of time, independent of the activation time of the activation button AB, which may vary depending on the user's activation. However, in alternative embodiments, the predetermined period of time, where the atomizers FA, SA are activated, may be modified according to the activation time of the activation button AB.

The present embodiment illustrates substantially simultaneous activation of the first and second atomizers FA, SA, and substantially the same time of activation of the atomizers FA, SA.

Figure 10B:
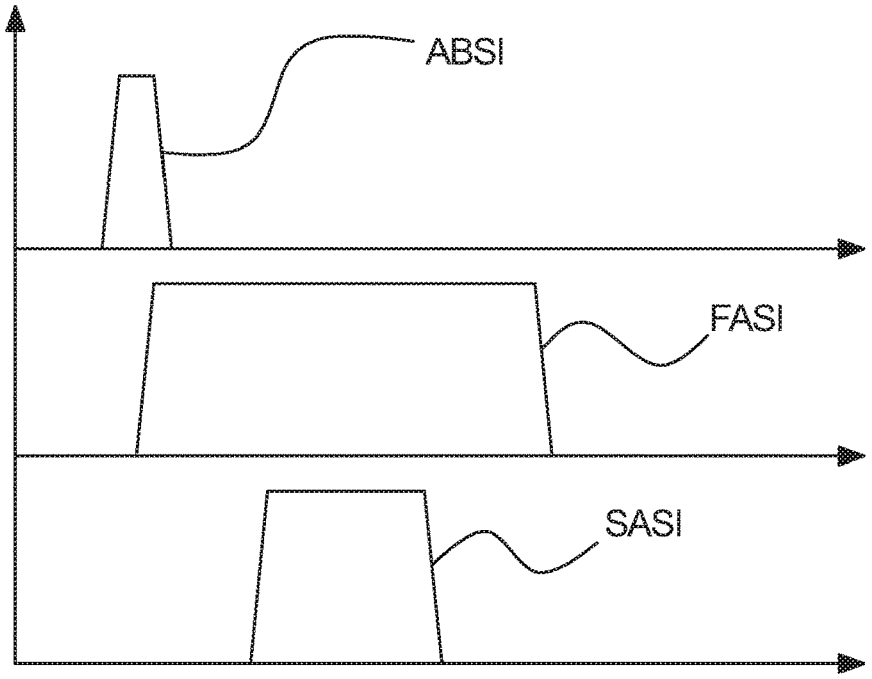

Now referring to FIG. 10B an embodiment of the invention is illustrated. As an alternative to the embodiment of FIG. 10A, FIG. 10B illustrates that first atomizer FA is activated immediately or shortly after activation of the activation button AB, whereas the second atomizer SA is activated only after a predetermined time delay. In some alternative embodiments, it is the second atomizer SA that is activated first.

Furthermore, the first atomizer FA remains activated for a predetermined period of time after the activation of the second atomizer SA is terminated. In some alternative embodiments, it is the activation of the second atomizer SA that is terminated at the latest point of time.

Figure 11A:
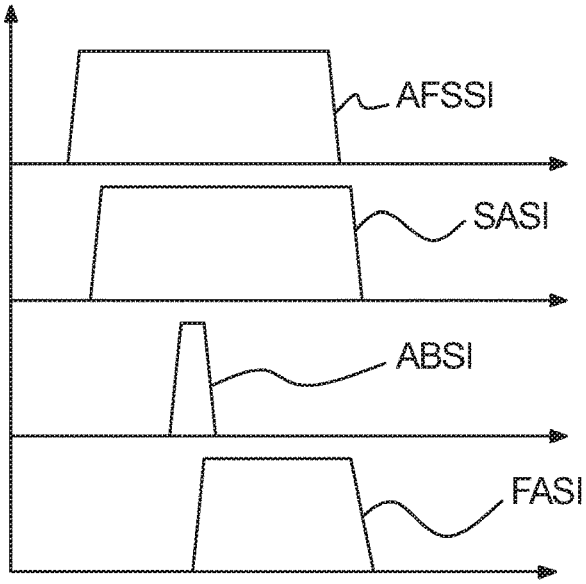
FIG. 11A-11C illustrate the timing of dispensing of components from an electronic nicotine delivery system according to different embodiments.

FIG. 11A illustrates a further embodiment of the invention. Here the activation of the second atomizer is triggered by an air flow sensor signal AFSSI indicative of a user applying a reduced pressure to the mouth piece MP. The first atomizer is not activated until the activation button AB is activated.

This setup allows the content of the additive container AC, such as e.g. flavoring and/or pH-controlling agent, such as a buffering agent, to be delivered to the user before the content of the nicotine container NC.

Figure 11B:
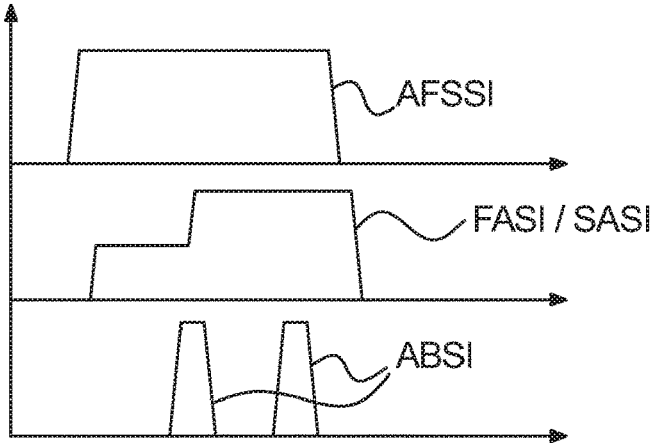
Figure 11C:
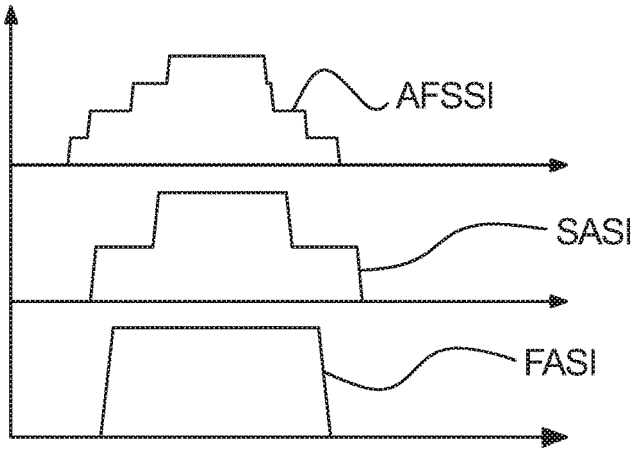

FIG. 11B illustrates a further embodiment of the invention. In this embodiment, the first and/or second atomizer FA, SA is activated when the air flow sensor signal AFSSI is received by the electronic control arrangement ECA. However, when the activation button AB is activated, the dose is increased, i.e. the delivery rate of content from the nicotine container and/or the additive container is increased.

As illustrated, the electronic control arrangement ECA may be configured to ignore further activations from the activation button AB to not increase the dispensed dose too much.

FIG. 11B illustrates a further embodiment of the invention. According to the embodiment, the air flow sensor AFS is able to measure the air flow stepwise. In some embodiments, the number of steps may be so high that the air flow may be measured quasi-continuously.

In some embodiments the air flow sensor AFS is merely adapted for measuring if there is an air flow (above a certain threshold) or not.

As illustrated, the first and second atomizers may be activated according to threshold levels of the air flow sensor signal AFSSI. These thresholds may, as illustrated, differ for the first and second atomizers FA, SA. Also, the dispensed dose may, illustrated fir the second atomizer SA, vary for different levels of air flow. This may also be done for the first atomizer FA.

According to some embodiments, the dispensed dose from the first and/or second atomizer may be controlled to gradually increase or decrease the dose.

LIST OF FIGURE REFERENCES

ENDS. Electronic nicotine delivery system
MP. Mouth piece
AA. Atomizer arrangement
PS. Power supply
NC. Nicotine container
AC. Additive container
FA. First atomizer
SA. Second atomizer
TE. Transport element
HE. Heating element
CAS. Casing
AB. Activation button
AI. Air inlet
AAI. Additional air inlet
AFS. Air flow sensor
ECA. Electronic control arrangement
DC. Distribution conduit
OO. Output opening
IAP. Inner air passage
BAF. Baffle
VLV. Valve
LC. Liquid coupling
NCI. Inlet from nicotine container
ACI. Inlet from additive container
ABSI. Activation button signal
FASI. First atomizer signal
SASI. Second atomizer signal
AFSSI. Air flow sensor signal

The invention claimed is:

1. An electronic nicotine delivery system comprising a mouth piece, an atomizer arrangement, a power supply, a nicotine container, an additive container, the atomizer arrangement comprising an inlet from the nicotine container and an inlet from the additive container, the atomizer arrangement comprising two separate atomizers, a first atomizer and a second atomizer, the first atomizer producing nicotine-containing aerosols having a first mass median aerodynamic diameter and the second atomizer producing additive-containing aerosols having a second mass median aerodynamic diameter and wherein the second mass median aerodynamic diameter is greater than the first mass median aerodynamic diameter, the atomizers being electrically connected to the power supply, wherein the additive container comprises nicotine, wherein the nicotine-containing aerosols comprise a first pH-controlling agent and the additive-containing aerosols comprise a second pH-controlling agent, wherein the first pH-controlling agent is more acidic than the second pH-controlling agent.

2. The Electronic nicotine delivery system according to claim 1, wherein the first mass median aerodynamic diameter is below 5 micrometer.

3. The electronic nicotine delivery system according to claim 1, wherein the second mass median aerodynamic diameter is greater than 4 micrometers.

4. The electronic nicotine delivery system according to claim 1, wherein the first atomizer produces aerosols on basis of nicotine-solution received from the nicotine container and where the second atomizer produces aerosols on basis of additive/additive solution received from the additive container.

5. The electronic nicotine delivery system according to claim 1, wherein the first mass median aerodynamic diameter is established to facilitate transport of nicotine-containing aerosols to the lungs of a user of the electronic nicotine delivery system.

6. The electronic nicotine delivery system according to claim 1, wherein the second mass median aerodynamic diameter is established to facilitate uptake of the additive containing aerosols in the oral cavity of a user of the electronic nicotine delivery system.

7. The electronic nicotine delivery system according to claim 1, wherein said nicotine container comprises nicotine in an amount of 0.01-5% by weight of the nicotine solution.

8. The electronic nicotine delivery system according to claim 1, wherein the nicotine-containing aerosols comprise an acidic pH-controlling agent.

9. The electronic nicotine delivery system according to claim 1, wherein the additive-containing aerosols comprise an alkaline pH-controlling agent.

10. A method of producing a mixture of aerosols in an electronic nicotine delivery system comprising a mouthpiece, the method comprising the steps of:

establishing nicotine-containing aerosols having a first mass median aerodynamic diameter, establishing additive-containing aerosols having a second mass median aerodynamic diameter, the second mass median aerodynamic diameter being greater than the first mass median aerodynamic diameter, and creating an output of a mixture of the nicotine-containing aerosols having a first mass median aerodynamic diameter and additive-containing aerosols having a second mass median aerodynamic diameter via the mouthpiece, wherein the additive container comprises nicotine, wherein the nicotine-containing aerosols comprise a first pH-controlling agent and the additive-containing aerosols comprise a second pH-controlling agent, wherein the first pH-controlling agent is more acidic than the second pH-controlling agent.

11. The electronic nicotine delivery system according to claim 1, where at least one of the atomizers comprises a transport element and/or a heating element.

12. The electronic nicotine delivery system according to claim 1, wherein at least one of the atomizers comprises an air flow regulator.

13. The electronic nicotine delivery system according to claim 1, wherein the heating power from the first atomizer is different from the heating power of the second atomizer.

14. The electronic nicotine delivery system according to claim 1, wherein the pharmaceutically acceptable excipients or carriers of the nicotine container are different from the pharmaceutically acceptable excipients or carriers of the additive container.

15. The electronic nicotine delivery system according to claim 1, wherein the air flow velocity at the first atomizer is different than the air flow velocity at the second atomizer.

16. The electronic nicotine delivery system according to claim 1, wherein the atomizer arrangement delivers an output of a mixture of aerosols via the mouth pieces and wherein the mixture of aerosols comprises nicotine-containing aerosols having a first mass median aerodynamic diameter and additive-containing aerosols having a second mass median aerodynamic diameter and wherein the second mass median aerodynamic diameter is greater than the first mass median aerodynamic diameter.

17. The electronic nicotine delivery system according to claim 1, wherein the electronic nicotine delivery system comprises an aerosol particle size controller for controlling the aerosol particle size after the aerosol is formed.

18. The electronic nicotine delivery system according to claim 1, wherein the electronic nicotine delivery system comprises an electronic control arrangement for activating the first and second atomizers in a synchronized manner.

* * * * *